US010677209B2

(12) United States Patent
Kato

(10) Patent No.: US 10,677,209 B2
(45) Date of Patent: Jun. 9, 2020

(54) FUEL INJECTION DEVICE

(71) Applicant: DENSO CORPORATION, Kariya, Aichi-pref. (JP)

(72) Inventor: Noritsugu Kato, Kariya (JP)

(73) Assignee: DENSO CORPORATION, Kariya (JP)

( * ) Notice: Subject to any disclaimer, the term of this patent is extended or adjusted under 35 U.S.C. 154(b) by 22 days.

(21) Appl. No.: 16/069,228

(22) PCT Filed: Jan. 27, 2017

(86) PCT No.: PCT/JP2017/002841
§ 371 (c)(1),
(2) Date: Jul. 11, 2018

(87) PCT Pub. No.: WO2017/145639
PCT Pub. Date: Aug. 31, 2017

(65) Prior Publication Data

US 2019/0003437 A1 Jan. 3, 2019

(30) Foreign Application Priority Data

Feb. 24, 2016 (JP) ..... 2016-033050

(51) Int. Cl.
*F02M 61/18* (2006.01)
*F02M 51/00* (2006.01)
*F02M 51/06* (2006.01)

(52) U.S. Cl.
CPC ..... *F02M 61/182* (2013.01); *F02M 51/00* (2013.01); *F02M 51/0614* (2013.01); *F02M 61/18* (2013.01)

(58) Field of Classification Search
CPC ..... F02M 61/82; F02M 61/18; F02M 51/00; F02M 51/0614
(Continued)

(56) References Cited

U.S. PATENT DOCUMENTS 8,967,500 B2 * 3/2015 Hashii ..... F02M 51/0671 239/533.12
2003/0132320 A1 * 7/2003 Sebastian ..... F02M 51/0671 239/596
(Continued)

FOREIGN PATENT DOCUMENTS

EP 1 517 017 3/2005
JP 2002-221128 8/2002
(Continued)

*Primary Examiner* — Steven J Ganey
(74) *Attorney, Agent, or Firm* — Nixon & Vanderhye P.C.

(57) ABSTRACT

In an injection hole set, primary and secondary injection holes are formed to satisfy the following relationship: $\gamma \leq \theta t1+\theta t2-0.87\times P^{0.52}$, where γ (deg) is an injection-hole-to-injection-hole angle, which is an angle formed between a primary central axis of the primary injection hole and a secondary central axis of the secondary injection hole; θt1 (deg) is a primary taper angle, which is an angle formed between outlines of a primary injection hole inner wall of the primary injection hole in a cross section of the primary injection hole inner wall; θt2 (deg) is a secondary taper angle, which is an angle formed between outlines of a secondary injection hole inner wall of the secondary injection hole in a cross section of the secondary injection hole inner wall; and P (MPa) is an average pressure of the fuel in a fuel passage at a time of injecting the fuel from the injection holes.

6 Claims, 13 Drawing Sheets

(58) Field of Classification Search
USPC ..... 239/552, 533.12, 585.1, 585.4, 585.5, 239/596, 601
See application file for complete search history.

(56) References Cited

U.S. PATENT DOCUMENTS

| | | | | |
|---|---|---|---|---|
| 2004/0237929 | A1* | 12/2004 | Cavanagh | F02M 61/182 239/533.12 |
| 2006/0118660 | A1* | 6/2006 | Kuegler | F02M 45/086 239/533.12 |
| 2010/0288857 | A1 | 11/2010 | Hashii et al. | |
| 2013/0104847 | A1 | 5/2013 | Ishii et al. | |
| 2014/0021274 | A1 | 1/2014 | Hashii et al. | |

FOREIGN PATENT DOCUMENTS

| | | |
|---|---|---|
| JP | 2004-204806 | 7/2004 |
| JP | 2005-194929 | 7/2005 |
| JP | 4085944 | 5/2008 |
| JP | 2012-246897 | 12/2012 |
| JP | 2015-021390 | 2/2015 |

* cited by examiner

FUEL INJECTION DEVICE

CROSS REFERENCE TO RELATED APPLICATION

This application is the U.S. national phase of International Application No. PCT/JP2017/002841 filed Jan. 27, 2017, which designated the U.S. and claims priority to Japanese Patent Application No. 2016-33050 filed on Feb. 24, 2016, the entire contents of each of which are hereby incorporated by reference.

TECHNICAL FIELD

The present disclosure relates to a fuel injection device that injects fuel.

BACKGROUND ART

Previously, there is known a fuel injection device that includes a plurality of injection holes. The patent literature 1 discloses a structure, in which a diverging angle between a primary injection hole and a secondary injection hole, i.e., an injection-hole-to-injection-hole angle, which is an angle defined between central axes of the injection holes, is set to 15 to 25 degrees. With this setting, the Coanda effect is generated between fuel mists injected from the injection holes, so that the fuel mists are pulled toward each other. In this way, a rich mixture gas, which is atomized, is generated at a center side between the fuel mists.

It is assumed that an inner wall of each injection hole is shaped into a cylindrical form, i.e., a straight form at the fuel injection device of the patent literature 1. In the case where the inner wall of each injection hole is in the straight form, a large difference is generated between: a mist angle, which is an angle defined between outlines of the fuel mist injected from the injection hole at a time of generating a high fuel pressure in the fuel injection device; and a mist angle, which is an angle defined between outlines of the fuel mist injected from the injection hole at a time of generating a low fuel pressure in the fuel injection device. Therefore, a degree of the Coanda effect, which is generated between the fuel mists injected from the injection holes, may possibly be changed depending on the fuel pressure in the fuel injection device.

In the fuel injection device of the patent literature 1, in a case where the mist angle of the fuel mist injected from each injection hole is excessively increased at the time of, for example, the high fuel pressure, the Coanda effect may be excessively exerted, so that the fuel mists collide with each other to interfere the atomization of the fuel mist at the center side between the fuel mists. In contrast, in a case where the mist angle of the fuel mist injected from each injection hole is excessively reduced at the time of, for example, the low fuel pressure, the Coanda effect may not be exerted, so that the concentration of the mixture gas at the center side between the fuel mists may possibly be decreased.

CITATION LIST

Patent Literature

PATENT LITERATURE 1: JP4085944B2 (corresponding to EP1517017A1)

SUMMARY OF INVENTION

The present disclosure is made in view of the above disadvantage, and it is an objective of the present disclosure to provide a fuel injection device that can stably generate the Coanda effect between two fuel mists regardless of a change in a fuel pressure.

A fuel injection device of the present disclosure includes a nozzle.

The nozzle includes: a nozzle tubular portion that forms a fuel passage in an inside of the nozzle tubular portion; a nozzle bottom portion that closes one end of the nozzle tubular portion; and a plurality of injection holes that connect between one surface of the nozzle bottom portion, which is located on a side where the nozzle tubular portion is placed, and an opposite surface of the nozzle bottom portion, which is located on an opposite side that is opposite from the nozzle tubular portion, to inject fuel of the fuel passage.

The plurality of injection holes includes at least one injection hole set that includes a primary injection hole and a secondary injection hole.

The primary injection hole has: a primary inlet opening, which is formed at the one surface of the nozzle bottom portion located on the side where the nozzle tubular portion is placed; a primary outlet opening, which is formed at the opposite surface of the nozzle bottom portion located on the opposite side that is opposite from the nozzle tubular portion; and a primary injection hole inner wall, which connects between the primary inlet opening and the primary outlet opening and is tapered such that the primary injection hole inner wall is progressively spaced away from a primary central axis, which is a central axis of the primary injection hole, from the primary inlet opening side toward the primary outlet opening side.

The secondary injection hole has: a secondary inlet opening, which is formed at the one surface of the nozzle bottom portion located on the side where the nozzle tubular portion is placed; a secondary outlet opening, which is formed at the opposite surface of the nozzle bottom portion located on the opposite side that is opposite from the nozzle tubular portion; and a secondary injection hole inner wall, which connects between the secondary inlet opening and the secondary outlet opening and is tapered such that the secondary injection hole inner wall is progressively spaced away from a secondary central axis, which is a central axis of the secondary injection hole, from the secondary inlet opening side toward the secondary outlet opening side.

According to the present disclosure, with respect to the injection hole set, $\gamma$ (deg) is defined as an injection-hole-to-injection-hole angle, which is an angle formed between the primary central axis and the secondary central axis; $\theta t1$ (deg) is defined as a primary taper angle, which is an angle formed between outlines of the primary injection hole inner wall in a cross section of the primary injection hole inner wall taken along an imaginary plane that includes all of the primary central axis; $\theta t2$ (deg) is defined as a secondary taper angle, which is an angle formed between outlines of the secondary injection hole inner wall in a cross section of the secondary injection hole inner wall taken along an imaginary plane that includes all of the secondary central axis; and P (MPa) is defined as an average pressure of the fuel in the fuel passage at a time of injecting the fuel from the plurality of injection holes; and the primary injection hole and the secondary injection hole are formed to satisfy a relationship of the following equation 1:

$$\gamma \leq \theta t1 + \theta t2 - 0.87 \times P\hat{}0.52 \qquad \text{Equation 1}$$

Here, ^ of the equation 1 denotes "to a power of."

In the present disclosure, the primary injection hole and the secondary injection hole are formed to satisfy the equation 1, so that the Coanda effect can be effectively generated between the fuel mist, which is injected from the primary injection hole, and the fuel mist, which is injected from the secondary injection hole.

Furthermore, according to the present disclosure, the primary injection hole inner wall and the secondary injection hole inner wall are tapered, so that the primary injection hole or the secondary injection hole discharges the fuel to spread the fuel. Therefore, it is possible to reduce a difference between: a mist angle of the fuel mist, which is injected from each injection hole in the state where the fuel pressure in the fuel passage is high; and a mist angle of the fuel mist, which is injected from each injection hole in the state where the fuel pressure in the fuel passage is low. Therefore, even when the fuel pressure in the fuel passage changes, it is possible to limit a change in the mist angle of the fuel mist, which is injected from the primary injection hole or the secondary injection hole. Thereby, regardless of the change in the fuel pressure, the Coanda effect can be stably generated between the fuel mist, which is injected from the primary injection hole, and the fuel mist, which is injected from the secondary injection hole. Thus, regardless of the change in the fuel pressure, a rich mixture gas, which is atomized at the center side between the fuel mists, can be stably generated.

BRIEF DESCRIPTION OF DRAWINGS

The present disclosure, together with additional objectives, features and advantages thereof, will be best understood from the following description in view of the accompanying drawings.

DESCRIPTION OF EMBODIMENTS

Hereinafter, various embodiments of the present disclosure will be described with reference to the drawings. In the following embodiments, substantially identical structural portions will be indicated by the same reference signs and will not be described redundantly for the sake of simplicity.

First Embodiment

Figure 1:
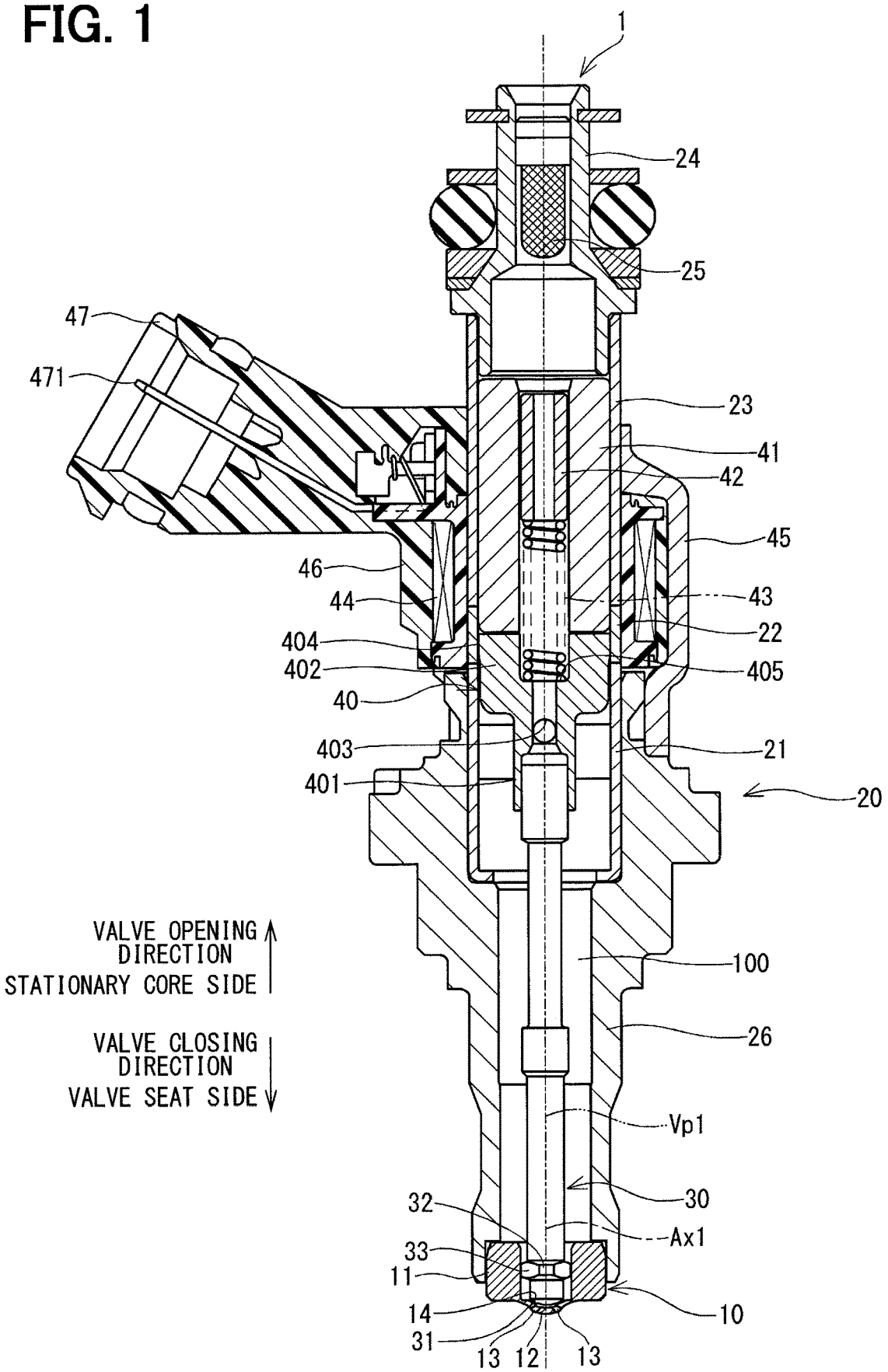
FIG. 1 is a cross-sectional view showing a fuel injection device according to a first embodiment of the present disclosure.

FIG. 1 indicates a fuel injection device according to a first embodiment of the present disclosure. The fuel injection device 1 is applied to, for example, a gasoline engine (hereinafter simply referred to as an engine) 80, which serves as an internal combustion engine, to inject gasoline, which serves as fuel, in the engine 80 (see FIG. 2).

Figure 2:
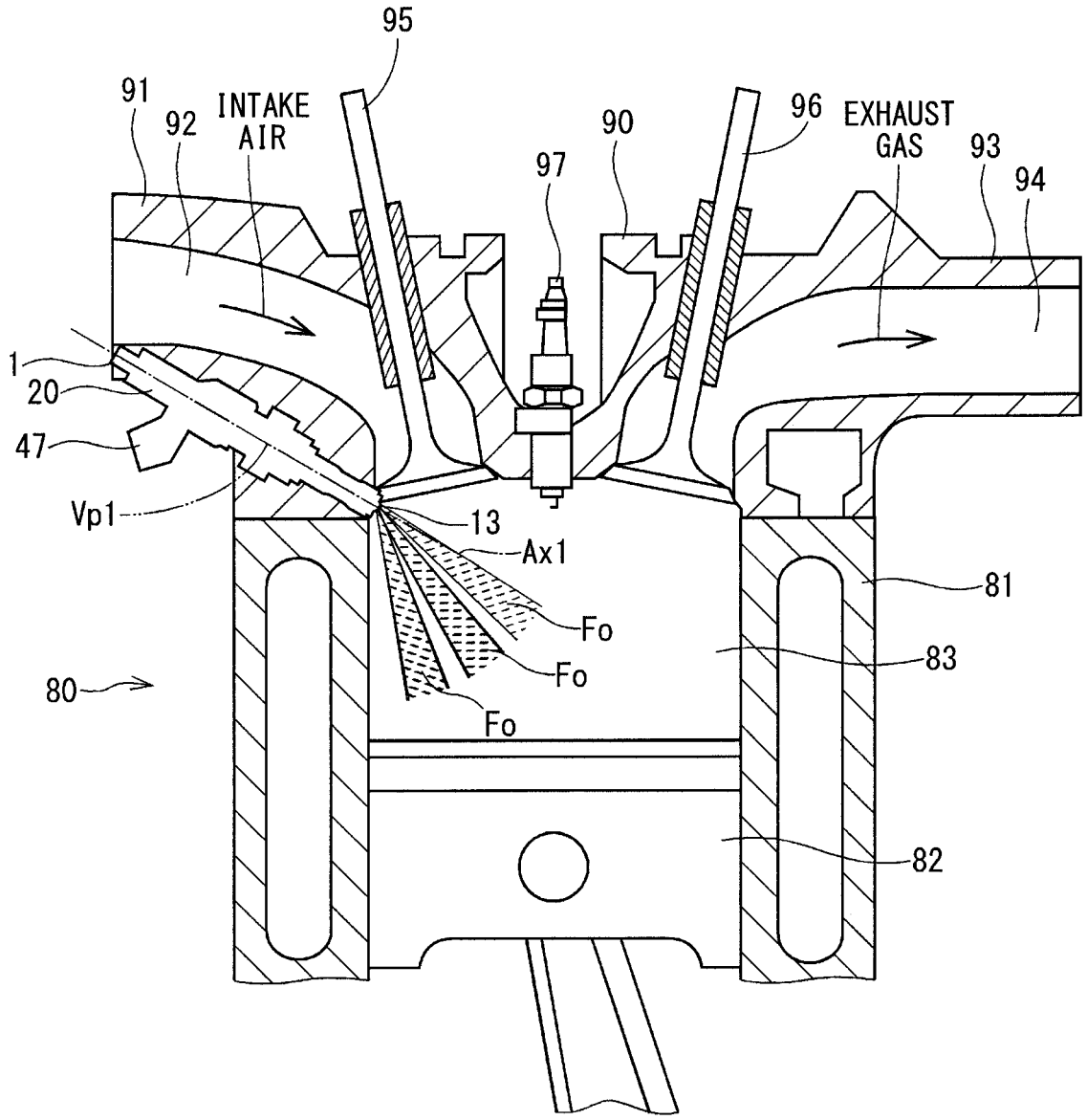
FIG. 2 is a diagram showing a state where the fuel injection device according to the first embodiment of the present disclosure is applied to an internal combustion engine.

As shown in FIG. 2, the engine 80 includes: a cylinder block 81, which is shaped into a cylindrical tubular form; a piston 82; a cylinder head 90; an intake valve 95; and an exhaust valve 96. The piston 82 is operable to reciprocate in an inside of the cylinder block 81. The cylinder head 90 is installed such that the cylinder head 90 closes an opening end of the cylinder block 81. A combustion chamber 83 is defined by an inner wall of the cylinder block 81, a wall surface of the cylinder head 90 and the piston 82. A volume of the combustion chamber 83 is increased and then decreased in response to reciprocation of the piston 82.

The cylinder head 90 includes an intake manifold 91 and an exhaust manifold 93. An air intake passage 92 is formed in the intake manifold 91. One end of the air intake passage 92 is opened to the atmosphere, and the other end of the air intake passage 92 is connected to the combustion chamber 83. The air intake passage 92 conducts the air (hereinafter referred to as intake air), which is suctioned from the atmosphere, to the combustion chamber 83.

An exhaust passage 94 is formed in the exhaust manifold 93. One end of the exhaust passage 94 is connected to the combustion chamber 83, and the other end of the exhaust passage 94 is opened to the atmosphere. The exhaust passage 94 conducts the air (hereinafter referred to as exhaust gas), which includes combustion gas generated in the combustion chamber 83, to the atmosphere.

The intake valve 95 is installed to the cylinder head 90 such that the intake valve 95 is operable to reciprocate through rotation of a cam of a driven-side shaft that is rotated synchronously with rotation of a drive shaft (not shown). The intake valve 95 is operable to open and close a connection between the combustion chamber 83 and the air intake passage 92 through reciprocation of the intake valve 95. The exhaust valve 96 is installed to the cylinder head 90 such that the exhaust valve 96 is operable to reciprocate through rotation of a cam. The exhaust valve 96 is operable to open and close a connection between the combustion chamber 83 and the exhaust passage 94 through reciprocation of the exhaust valve 96.

In the present embodiment, the fuel injection device 1 is installed to a side of the air intake passage 92 of the intake manifold 91, at which the cylinder block 81 is placed. The fuel injection device 1 is placed such that an axis of the fuel injection device 1 is tilted relative to an axis of the combustion chamber 83 or is skew to the axis of the combustion chamber 83. In the present embodiment, the fuel injection device 1 is placed on a lateral side of the combustion chamber 83. That is, the fuel injection device 1 is mounted to the lateral side of the engine 80.

Furthermore, a spark plug 97, which serves as an ignition device, is placed at a corresponding location of the cylinder head 90, which is between the intake valve 95 and the exhaust valve 96, i.e., a corresponding location of the cylinder head 90 that corresponds to a center of the combustion chamber 83. The spark plug 97 is placed at the location where the fuel injected from the fuel injection device 1 does not directly adhere to the spark plug 97, and the spark plug 97 can ignite the mixture gas (combustible air), which is a mixture of the fuel and the intake air. As discussed above, the engine 80 is a direction injection gasoline engine.

The fuel injection device 1 is placed such that a plurality of injection holes 13 of the fuel injection device 1 is exposed to a radially outer portion of the combustion chamber 83. Pressurized fuel, which is pressurized to a pressure corresponding to a fuel injection pressure by a fuel pump (not shown), is supplied to the fuel injection device 1. A conical fuel mist Fo is injected from the respective injection holes 13 of the fuel injection device 1 into the combustion chamber 83. When the fuel mist Fo is injected from the respective injection holes 13, a negative pressure Vc is generated between each adjacent two of the fuel mists Fo. Thereby, each adjacent fuel mists Fo are pulled toward each other. This phenomenon is known as the Coanda effect.

Next, a basic structure of the fuel injection device 1 will be described with reference to FIG. 1.

The fuel injection device 1 includes a nozzle 10, a housing 20, a needle 30, a movable core 40, a stationary core 41, a spring 43 (serving as a valve seat side urging member) and a coil 44.

The nozzle 10 is made of metal, such as martensitic stainless steel. The nozzle 10 is processed through a quenching process, so that the nozzle 10 has a predetermined degree of hardness. As shown in FIG. 1, the nozzle 10 includes a nozzle tubular portion 11, a nozzle bottom portion 12, the injection holes 13 and a valve seat 14.

The nozzle tubular portion 11 is shaped into a tubular form. The nozzle bottom portion 12 closes one end of the nozzle tubular portion 11. Each of the injection holes 13 is configured to connect between one surface 121, i.e., an inner wall of the nozzle bottom portion 12, which is located on a side where the nozzle tubular portion 11 is placed, and an opposite surface 122, i.e., an outer wall of the nozzle bottom portion 12, which is located on an opposite side that is opposite from the nozzle tubular portion 11 (see FIG. 3). The injection holes 13 are formed as a plurality of injection holes at the nozzle bottom portion 12. In the present embodiment, the number of the injection holes 13 is six (see FIG. 4). The valve seat 14 is formed in a form of a ring around the injection holes 13 on a side of the nozzle bottom portion 12 where the nozzle tubular portion 11 is placed. The injection holes 13 will be described in detail later.

The housing 20 includes a nozzle holder 26, a first tubular member 21, a second tubular member 22, a third tubular member 23, an inlet portion 24 and a filter 25.

The nozzle holder 26 is shaped into a tubular form and is made of a magnetic material, such as ferritic stainless steel. An opposite end part of the nozzle tubular portion 11, which is opposite from the nozzle bottom portion 12, is connected to an inner side of one end of the nozzle holder 26. The nozzle holder 26 and the nozzle 10 are joined together by, for example, welding. In this way, the nozzle holder 26 holds the nozzle 10.

The first tubular member 21, the second tubular member 22 and the third tubular member 23 are respectively shaped into a generally cylindrical tubular form. The first tubular member 21, the second tubular member 22 and the third tubular member 23 are coaxially arranged one after another in this order and are joined together.

The first tubular member 21 and the third tubular member 23 are made of a magnetic material, such as ferritic stainless steel, and are processed through a magnetically-stabilizing process. The first tubular member 21 and the third tubular member 23 have a relatively low degree of hardness. In contrast, the second tubular member 22 is made of a non-magnetic material, such as austenitic stainless steel. A degree of hardness of the second tubular member 22 is higher than the degree of hardness of the first tubular member 21 and the third tubular member 23.

An outer wall of an opposite end part of the first tubular member 21, which is opposite from the second tubular member 22, is fitted to an inner wall of an opposite end part of the nozzle holder 26, which is opposite from the nozzle 10.

The inlet portion 24 is shaped into a tubular form and is made of a magnetic material, such as ferritic stainless steel. One end of the inlet portion 24 is joined to an opposite end part of the third tubular member 23, which is opposite from the second tubular member 22.

A fuel passage 100 is formed in an inside of the housing 20. The fuel passage 100 is connected to the injection holes 13. Specifically, the nozzle tubular portion 11 forms the fuel passage 100 in an inside of the nozzle tubular portion 11. A pipe (not shown) is joined to an opposite side of the inlet portion 24, which is opposite from the third tubular member 23. Thereby, fuel, which is fed from a fuel supply source (fuel pump), is supplied to the fuel passage 100 through the pipe. The fuel passage 100 conducts the fuel to the injection holes 13.

The filter 25 is installed in an inside of the inlet portion 24. The filter 25 collects foreign objects, which are contained in the fuel supplied to the fuel passage 100.

The needle 30 is shaped into a rod form and is made of metal, such as martensitic stainless steel. The needle 30 is processed through a quenching process, so that the needle 30 has a predetermined degree of hardness. The degree of hardness of the needle 30 is set to be substantially the same as the degree of hardness of the nozzle 10.

The needle 30 is received in the inside of the housing 20 such that the needle 30 is operable to reciprocate in the fuel passage 100 in the axial direction of the housing 20. The needle 30 has a seat portion 31 and a large diameter portion 32.

The seat portion 31 is formed at an end part of the needle 30 located on the nozzle 10 side and is contactable with the valve seat 14.

The large diameter portion 32 is formed near the seat portion 31 at the end part of the needle 30 located on the valve seat 14 side. An outer diameter of the large diameter portion 32 is set to be larger than an outer diameter of the end part of the needle 30 located on the valve seat 14 side. An outer wall of the large diameter portion 32 is configured to slide relative to an inner wall of the nozzle tubular portion 11 of the nozzle 10. In this way, the axial reciprocation of the end part of the needle 30, which is located on the valve seat 14 side, is guided. The large diameter portion 32 includes cutouts 33 that are formed by cutting a plurality of circumferential parts of the outer wall of the large diameter portion 32. In this way, the fuel can flow through gaps, each of which is defined between a corresponding one of the cutouts 33 and the inner wall of the nozzle tubular portion 11.

The needle 30 opens or closes the injection holes 13 when the seat portion 31 of the needle 30 is moved away from (lifted from) the valve seat 14 or contacts (seated against) the valve seat 14. Hereinafter, a direction of moving the needle 30 away from the valve seat 14 will be referred to as a valve opening direction, and a direction of contacting the needle 30 to the valve seat 14 will be referred to as a valve closing direction.

The movable core 40 is shaped into a tubular form and is made of a magnetic material, such as ferritic stainless steel. The movable core 40 is processed through a magnetically-stabilizing process. A degree of hardness of the movable core 40 is relatively low and is substantially the same as the degree of hardness of the first tubular member 21 and the third tubular member 23 of the housing 20.

The movable core 40 includes a first tubular portion 401 and a second tubular portion 402. The first tubular portion 401 and the second tubular portion 402 are integrally formed in one piece such that the first tubular portion 401 and the second tubular portion 402 are coaxial with each other. The first tubular portion 401 is formed such that an inner wall of one end of the first tubular portion 401 is fitted to an outer wall of a opposite end part of the needle 30, which is opposite from the valve seat 14. In the present embodiment, the movable core 40 and the needle 30 are joined together by welding. Therefore, the movable core 40 is operable to reciprocate together with the needle 30 in the axial direction in the inside of the housing 20.

The second tubular portion 402 is joined to the other end of the first tubular portion 401. An outer diameter of the second tubular portion 402 is set to be larger than an outer diameter of the first tubular portion 401.

Radial holes 403 are formed at the first tubular portion 401 such that each of the radial holes 403 extends in a radial direction to connect between an inner wall and an outer wall of the first tubular portion 401. In this way, the fuel can flow between the inside and the outside of the first tubular portion 401 (the movable core 40) through the radial holes 403.

The movable core 40 includes a projection 404 that radially outwardly projects in a form of a ring from an outer wall of an opposite end part of the second tubular portion 402, which is opposite from the first tubular portion 401. An outer wall of the projection 404 is slidable relative to the inner wall of the second tubular member 22 of the housing 20. Therefore, the axial reciprocation of the movable core 40 is guided by the inner wall of the second tubular member 22. Specifically, the axial reciprocation of the needle 30 and the axial reciprocation of the movable core 40 in the fuel passage 100 are guided by the inner wall of the nozzle tubular portion 11 and the inner wall of the second tubular member 22. Furthermore, the movable core 40 includes a stepped surface 405, which is shaped into a planar ring form and is placed at the inside of the second tubular portion 402.

The stationary core 41 is shaped into a generally cylindrical tubular form and is made of a magnetic material, such as ferritic stainless steel. The stationary core 41 is processed through a magnetically-stabilizing process. A degree of hardness of the stationary core 41 is relatively low and is substantially the same as the degree of hardness of the movable core 40. The stationary core 41 is placed on an opposite side of the movable core 40, which is opposite from the valve seat 14. The stationary core 41 is placed in the inside of the housing 20 such that an outer wall of the stationary core 41 is connected to an inner wall of the second tubular member 22 and an inner wall of the third tubular member 23. An end surface of the stationary core 41, which is located on the valve seat 14 side, is contactable with an end surface of the movable core 40, which is located on the stationary core 41 side.

An adjusting pipe 42, which is shaped into a cylindrical tubular form, is press fitted into the inside of the stationary core 41.

The spring 43 is, for example, a coil spring and is placed between the adjusting pipe 42, which is placed in the inside of the stationary core 41, and the stepped surface 405 of the movable core 40. One end of the spring 43 contacts the adjusting pipe 42. The other end of the spring 43 contacts the stepped surface 405. The spring 43 can urge the movable core 40 together with the needle 30 toward the valve seat 14 side, i.e., in the valve closing direction. An urging force of the spring 43 is adjusted by adjusting a position of the adjusting pipe 42 relative to the stationary core 41.

The coil 44 is shaped into a generally cylindrical tubular form and surrounds a radially outer side of the housing 20, particularly a radially outer side of the second tubular member 22 and a radially outer side of the third tubular member 23. Furthermore, a holder 45, which is shaped into a tubular form, is placed on a radially outer side of the coil 44 such that the holder 45 covers the coil 44. The holder 45 is made of a magnetic material, such as ferritic stainless steel. An inner wall of one end of the holder 45 is connected to an outer wall of the nozzle holder 26, and an inner wall of the other end of the holder 45 is connected to an outer wall of the third tubular member 23.

When an electric power is supplied to the coil 44 (when the coil 44 is energized), the coil 44 generates a magnetic force. When the magnetic force is generated at the coil 44, a magnetic circuit is formed through the stationary core 41, the movable core 40, the first tubular member 21, the nozzle holder 26, the holder 45 and the third tubular member 23. In this way, a magnetic attractive force is generated between the stationary core 41 and the movable core 40, and thereby the movable core 40 is magnetically attracted to the stationary core 41 together with the needle 30. In this way, the needle 30 is moved in the valve opening direction, and thereby the seat portion 31 is moved away from the valve seat 14 to result in valve opening. Thereby, the injection holes 13 are opened. As discussed above, when the coil 44 is energized, the movable core 40 can be magnetically attracted toward the stationary core 41 to move the needle 30 away from the valve seat 14 toward the opposite side that is opposite from the valve seat 14.

When the movable core 40 is magnetically attracted toward the stationary core 41 (i.e., in the valve opening direction) by the magnetic attractive force, the stationary core 41 side end surface of the movable core 40 collides against the movable core 40 side end surface of the stationary core 41. In this way, movement of the movable core 40 in the valve opening direction is limited.

When the energization of the coil 44 is stopped in the state where the movable core 40 is magnetically attracted to the stationary core 41, the needle 30 and the movable core 40 are urged toward the valve seat 14 by the urging force of the spring 43. In this way, the needle 30 is moved in the valve closing direction, and thereby the seat portion 31 contacts the valve seat 14 to result in valve closing. Therefore, the injection holes 13 are closed.

As shown in FIG. 1, a radially outer side of the third tubular member 23 and a radially outer side of the coil 44 are resin molded by the molding portion 46 that is made of resin. The connector portion 47 is formed to radially outwardly project from the molding portion 46. Terminals 471 for supplying the electric power to the coil 44 are insert molded in the connector portion 47. In a case where the housing 20 is divided into two portions along an imaginary plane Vp1, which includes all of an axis Ax1 of the nozzle tubular portion 11, the connector portion 47 is formed on one side of the imaginary plane Vp1 where one of the two portions is placed. Furthermore, the fuel injection device 1 is installed to the engine 80 such that piston 82 is located on the one side of the imaginary plane Vp1, and the spark plug 97 is located on the other side of the imaginary plane Vp1.

The fuel, which enters the inlet portion 24, flows through the filter 25, the inside of the stationary core 41, the inside of the adjusting pipe 42, the spring 43, the inside of the movable core 40, the radial holes 403, the gap between the needle 30 and the inner wall of the housing 20, and the gap between the needle 30 and the inner wall of the nozzle tubular portion 11, i.e., the fuel passage 100 and is guided to the injection holes 13. At the time of operating the fuel injection device 1, a surrounding space, which surrounds the movable core 40 and the needle 30, is filled with the fuel. Furthermore, at the time of operating the fuel injection device 1, the fuel flows through the radial holes 403 of the movable core 40. Therefore, the movable core 40 and the needle 30 can be smoothly reciprocated in the axial direction at the inside of the housing 20.

Next, the injection holes 13 of the present embodiment will be described in detail with reference to FIGS. 3 and 4.

Figure 3:
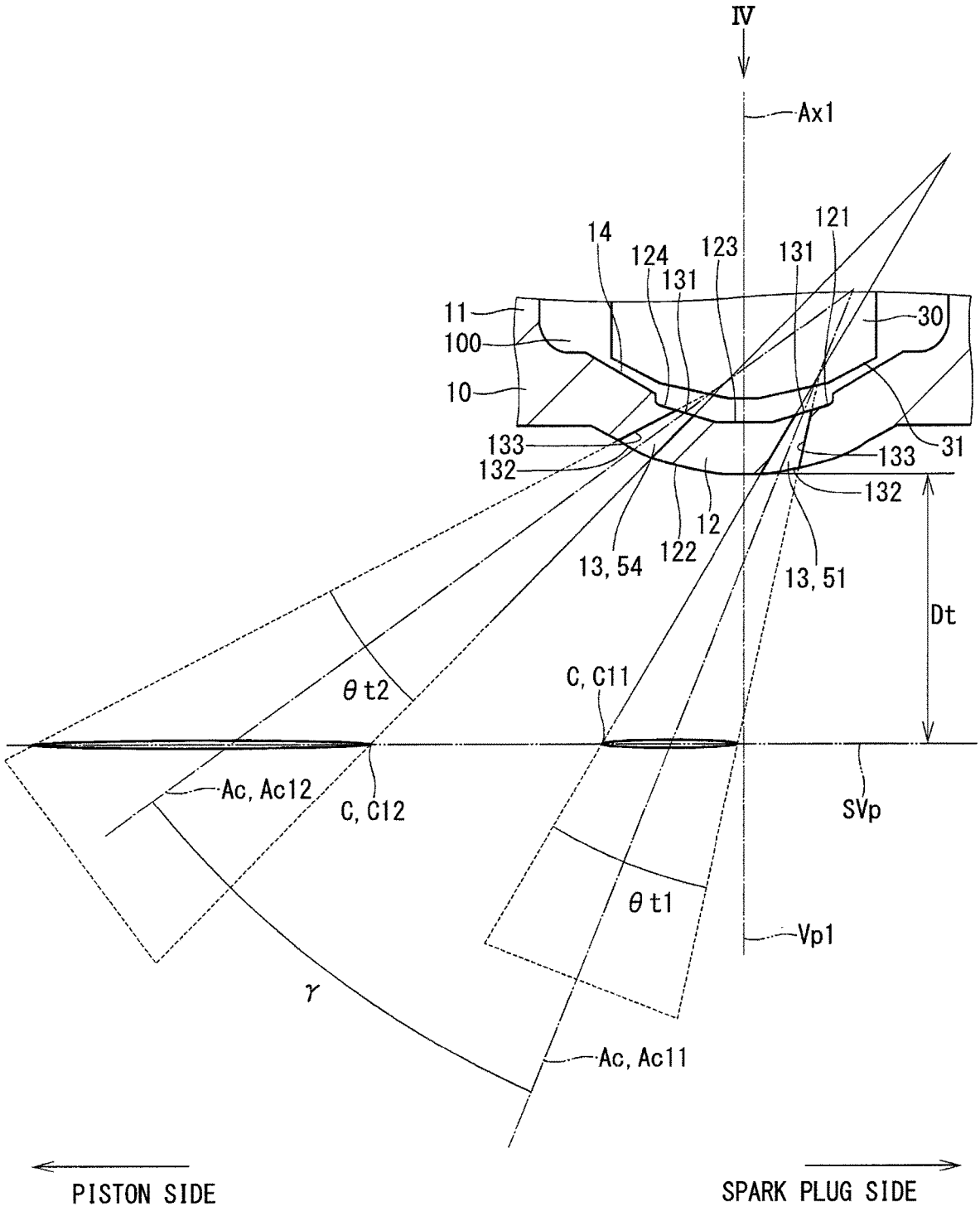
FIG. 3 is a cross-sectional view showing injection holes and its adjacent area of the fuel injection device according to the first embodiment of the present disclosure.

As shown in FIG. 3, each of the injection holes 13 includes an inlet opening 131, an outlet opening 132 and an injection hole inner wall 133. The inlet opening 131 is formed at the surface 121 of the nozzle bottom portion 12, which is located on the side where the nozzle tubular portion 11 is placed. The outlet opening 132 is formed at the opposite surface 122 of the nozzle bottom portion 12, which is opposite from the nozzle tubular portion 11.

A planar section 123 and a tapered section 124 are formed at the surface 121. The planar section 123 is formed in a form of a planar circular surface at a center of the surface 121. The axis Ax1 of the nozzle tubular portion 11 extends through a center of the planar section 123, and the planar section 123 is substantially perpendicular to the axis Ax1. The tapered section 124 is in a form of a ring and is formed continuously from the planar section 123 on a radially outer side of the planar section 123. The tapered section 124 is tapered such that the tapered section 124 is progressively spaced away from the axis Ax1 of the nozzle tubular portion 11 from the planar section 123 toward the nozzle tubular portion 11. In the present embodiment, each inlet opening 131 is formed at the tapered section 124.

The injection hole inner wall 133 is connected to the inlet opening 131 and the outlet opening 132. Furthermore, the injection hole inner wall 133 is tapered such that the injection hole inner wall 133 is progressively spaced away from a central axis Ac of the injection hole 13 from the inlet opening 131 side toward the outlet opening 132 side.

Figure 4:
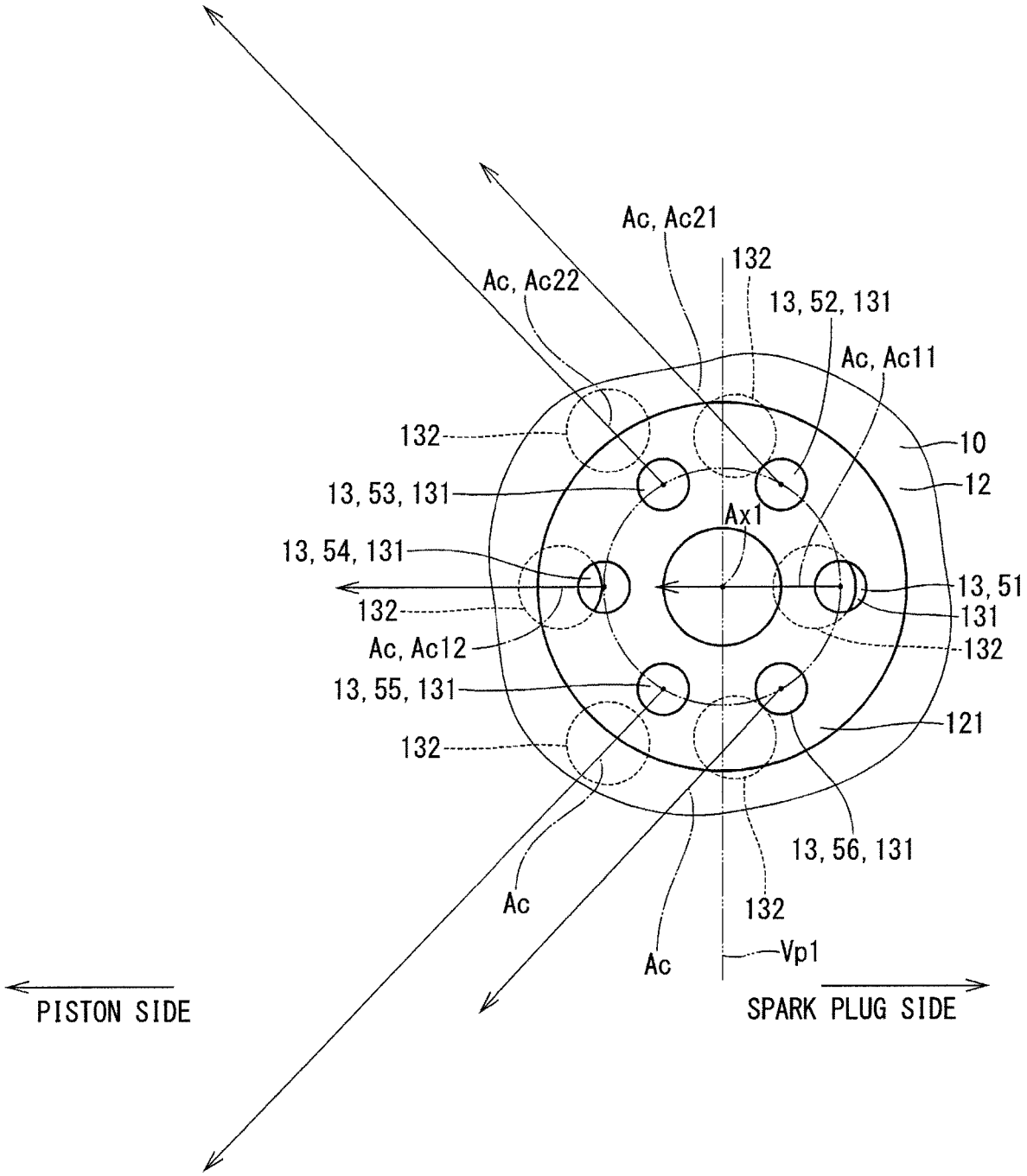
FIG. 4 is a view taken in a direction of an arrow IV in FIG. 3.

In the present embodiment, as shown in FIG. 4, the number of the inlet openings 131 of the injection holes 13 is six, and these inlet openings 131 of the injection holes 13 are arranged one after another at equal intervals in the circumferential direction of the nozzle bottom portion 12. Specifically, the inlet openings 131 of the six injection holes 13 are arranged one after another at 60 degree intervals in the circumferential direction of the nozzle bottom portion 12. Here, for the descriptive purpose, the six injection holes 13 will be referred to as injection holes 51, 52, 53, 54, 55, 56.

In the present embodiment, the injection holes 51, 52, 53, 54, 55, 56 are arranged one after another in this order in the circumferential direction of the nozzle bottom portion 12 (see FIG. 4). The injection holes 51-56 are placed one after another along an imaginary circle that is centered at the axis Ax1 of the nozzle tubular portion 11. In the present embodiment, the fuel injection device 1 is installed to the engine 80 such that the injection holes 51, 52, 56 are placed on the spark plug 97 side of the imaginary plane Vp1, and the injection holes 53, 54, 55 are placed on the piston 82 side of the imaginary plane Vp1.

Furthermore, since the inlet opening 131 and the outlet opening 132 of each injection hole 13 are formed at the tapered section 124 or a curved section of the nozzle bottom portion 12, the inlet opening 131 and the outlet opening 132 respectively look like in a form of an ellipse in reality in a view taken in the axis Ax1. However, for the sake of simplicity, the inlet opening 131 and the outlet opening 132 are respectively shaped in a form of a circle in FIG. 4.

Here, the injection holes 51, 52, 56 correspond to primary injection holes of the claims. Furthermore, the injection holes 54, 53, 55 correspond to secondary injection holes of the claims.

Furthermore, a set of the injection hole 51 and the injection hole 54, a set of the injection hole 52 and the injection hole 53 and a set of the injection hole 56 and the injection hole 55 correspond to injection hole sets of the claims. Specifically, in the present embodiment, the injection holes 13 include three sets of injection holes.

Next, the injection hole set of the injection hole 51 and the injection hole 54 will be described with reference to FIGS. 3 and 4.

The inlet opening 131, the outlet opening 132, the injection hole inner wall 133 and the central axis Ac of the injection hole 51, which serves as the primary injection hole, correspond to a primary inlet opening, a primary outlet opening, a primary injection hole inner wall and a primary central axis of the claims.

The inlet opening 131, the outlet opening 132, the injection hole inner wall 133 and the central axis Ac of the injection hole 54, which serves as the secondary injection hole, correspond to a secondary inlet opening, a secondary outlet opening, a secondary injection hole inner wall and a secondary central axis of the claims.

In the present embodiment, as shown in FIG. 3, with respect to one of the injection hole sets (e.g., a first injection hole set: the injection hole set of the injection hole 51 and the injection hole 54), $\gamma$ (deg) is defined as an injection-hole-to-injection-hole angle, which is an angle formed between the central axis (serving as the primary central axis) Ac11 of the injection hole 51 and the central axis (serving as the secondary central axis) Ac12 of the injection hole 54; $\theta t1$ (deg) is defined as a primary taper angle, which is an angle formed between outlines of the injection hole inner wall (serving as the primary injection hole inner wall) 133 of the injection hole 51 in a cross section of the injection hole inner wall 133 taken along an imaginary plane that includes all of the primary central axis Ac11; $\theta t2$ (deg) is defined as a secondary taper angle, which is an angle formed between outlines of the injection hole inner wall (serving as the secondary injection hole inner wall) 133 of the injection hole 54 in a cross section of the injection hole inner wall 133 taken along an imaginary plane that includes all of the secondary central axis Ac12; and P (MPa) is defined as an average pressure of the fuel in the fuel passage 100 at a time of injecting the fuel from the plurality of injection holes 13. Under the above setting, the injection hole (serving as the primary injection hole) 51 and the injection hole (serving as the secondary injection hole) 54 are formed to satisfy a relationship of the following equation 1.

$$\gamma \leq \theta t1 + \theta t2 - 0.87 \times P\hat{}0.52 \quad \text{Equation 1}$$

Here, ^ of the equation 1 denotes "to a power of."

Furthermore, in the present embodiment, the primary injection hole and the secondary injection hole are formed to satisfy a relationship of the following equation 2.

$$\theta t1 + \theta t2 - 10 \leq \gamma \quad \text{Equation 2}$$

Similarly, the primary injection hole and the secondary injection hole of the other injection hole sets (the injection hole set of the injection hole 52 and the injection hole 53, and the injection hole set of the injection hole 56 and the injection hole 55) are also formed to satisfy the relationships of the equation 1 and the equation 2 discussed above. In the injection hole set of the injection hole 52 and the injection hole 53, and the injection hole set of the injection hole 56 and the injection hole 55, the primary central axis and the secondary central axis are skew to each other. In this case, the injection-hole-to-injection-hole angle γ corresponds to an angle formed between the primary central axis and a straight line while the straight line extends from a point along the primary central axis in parallel with the secondary central axis.

Furthermore, according to the above equation 1, there is satisfied the following relationship.

$$\gamma - (\theta t1 + \theta t2) \leq -0.87 \times P\hat{}0.52$$

A pressure of the fuel in the fuel passage 100, which is assumed to be exerted in the fuel passage 100 during the use of the fuel injection device 1 of the present embodiment, is, for example, about 20 MPa. Therefore, in the present embodiment, P is 20 (MPa), and −0.87×P^0.52 is about −4 (deg).

Furthermore, in the present embodiment, the taper angle (θt1, θt2) of each of the injection holes 51-56 is set to be, for example, about 18 (deg). Therefore, according to the equation 1 and the equation 2, there is satisfied the following relationship.

$$26 \leq \gamma \leq 32 (\text{deg})$$

Furthermore, there is also satisfied the following relationship.

$$\gamma - (\theta t1 + \theta t2)/2 \leq 14 (\text{deg})$$

As shown in FIG. 4, the fuel mist, which is injected from each of the injection holes 51-56, is injected in a direction of a corresponding arrow that extends along the central axis Ac of the injection hole 51-56.

Figure 5:
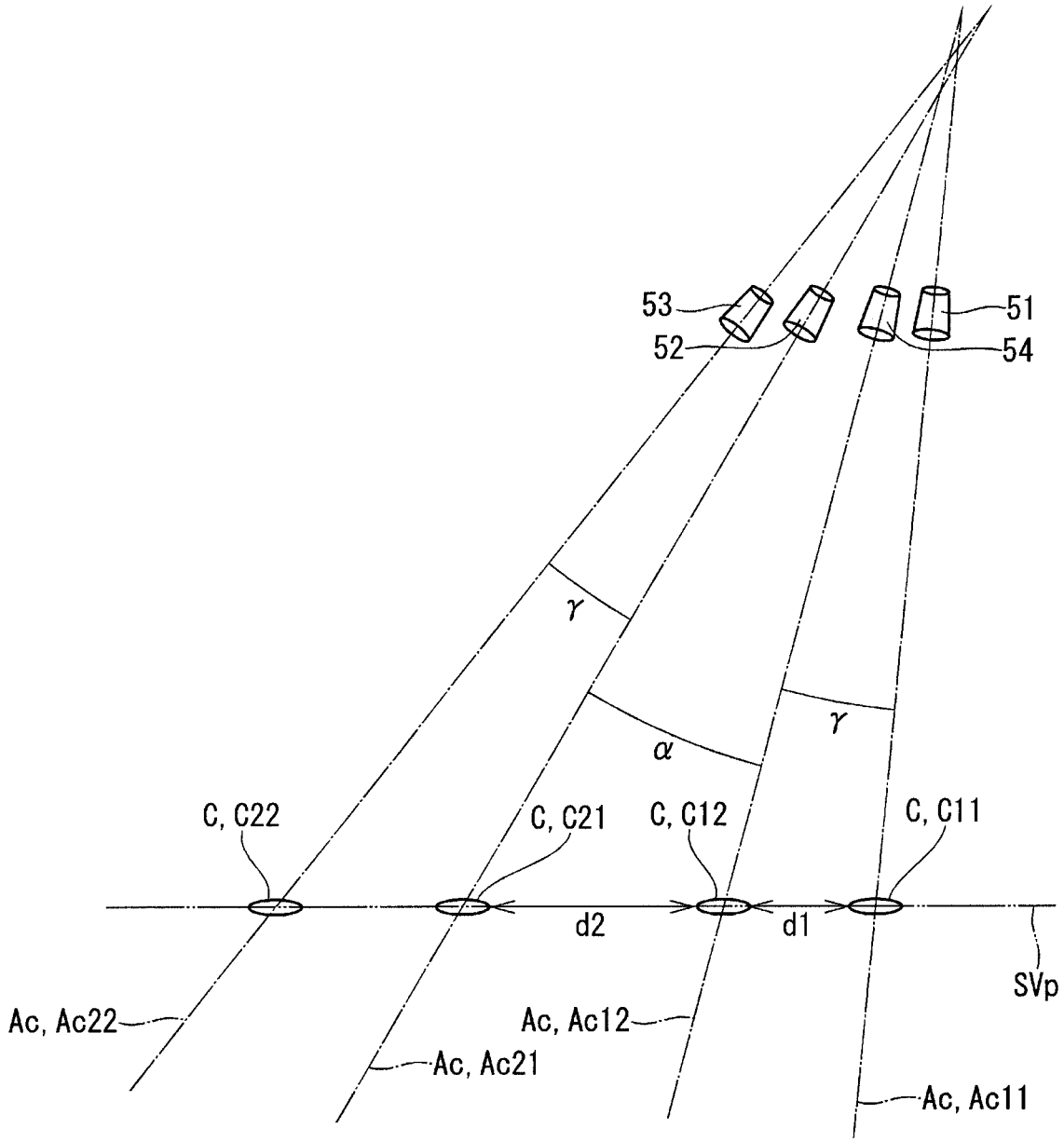
FIG. 5 is a schematic diagram showing a relationship among the injection holes of the fuel injection device according to the first embodiment of the present disclosure.

With reference to FIG. 5, α (deg) is defined as a hole-set-to-hole-set angle that is an angle formed between: the primary central axis Ac11 or the secondary central axis Ac12 of the first injection hole set (e.g., the injection hole set of the injection hole 51 and the injection hole 54), which is the one injection hole set selected from the three injection hole sets; and the primary central axis Ac21 or the secondary central axis Ac22 of the second injection hole set (e.g., the injection hole set of the injection hole 52 and the injection hole 53), which is the different injection hole set that is different from the first injection hole set among the three injection hole sets. Under the above setting, the first injection hole set and the second injection hole set are formed to satisfy a relationship of the following equation 3.

$$\gamma < \alpha \quad \text{Equation 3}$$

This is also true with respect to the relationship relative to the other injection hole set (the injection hole set of the injection hole 56 and the injection hole 55).

Figure 6:
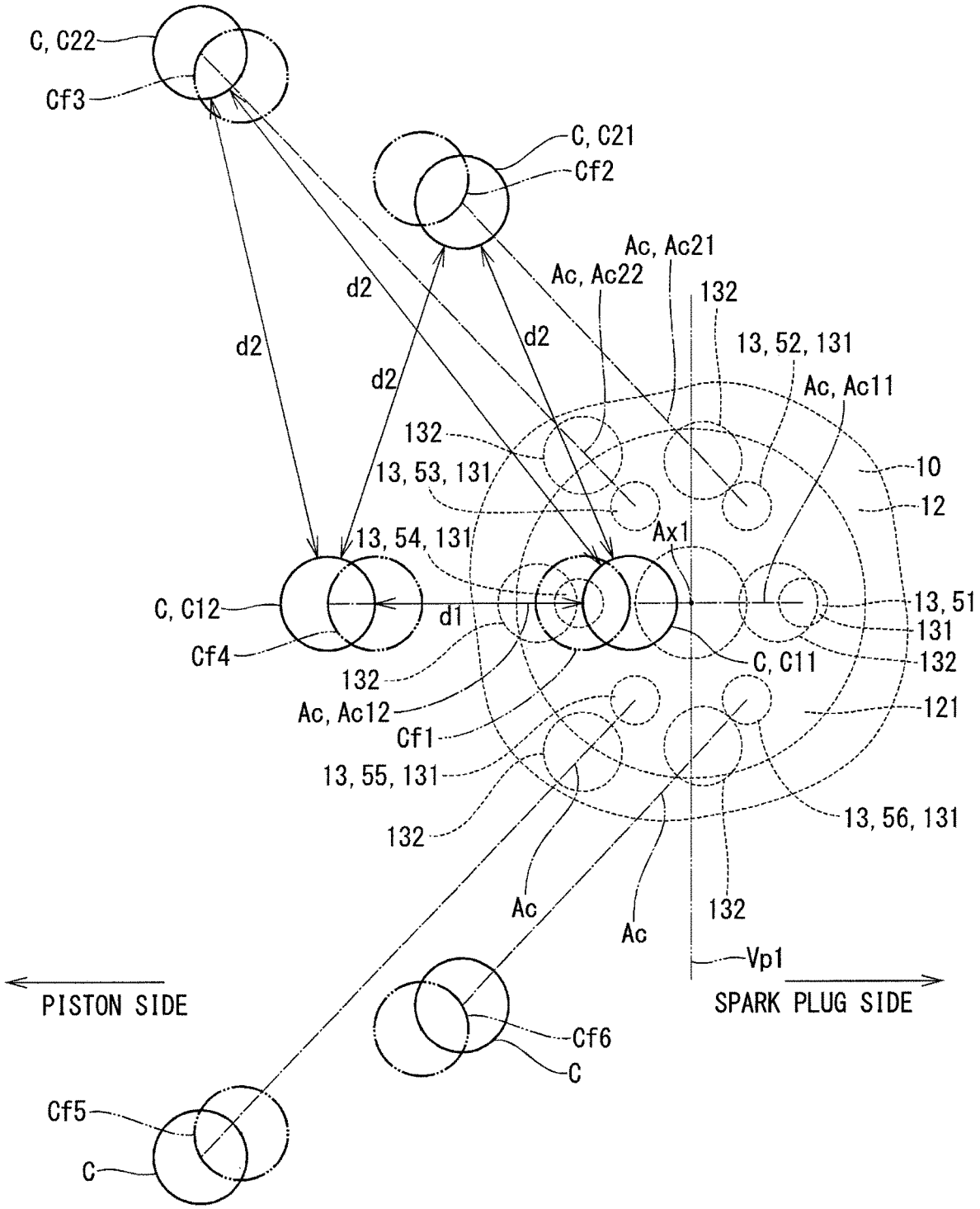
FIG. 6 is a schematic diagram showing a positional relationship among fuel mists injected from the fuel injection device according to the first embodiment of the present disclosure.

With reference to FIG. 6, C is defined as a circle, which is formed by a line of intersection between: a specific imaginary plane SVp (see FIG. 3) that is an imaginary plane spaced from the nozzle bottom portion 12 by a predetermined distance Dt on the opposite side, which is opposite from the nozzle tubular portion 11, while the imaginary plane is perpendicular to the axis Ax1 of the nozzle tubular portion 11; and an imaginary conical surface that includes all of the primary injection hole inner wall 133 of each injection hole 13. Then, C11 is defined as a circle that is formed by a line of intersection between: the specific imaginary plane SVp; and an imaginary conical surface that includes all of the primary injection hole inner wall of the first injection hole set (e.g., the injection hole set of the injection hole 51 and the injection hole 54). C12 is defined as a circle that is formed by a line of intersection between: the specific imaginary plane SVp; and an imaginary conical surface that includes all of the secondary injection hole inner wall of the first injection hole set. C21 is defined as a circle that is formed by a line of intersection between: the specific imaginary plane SVp; and an imaginary conical surface that includes all of the primary injection hole inner wall of the second injection hole set (e.g., the injection hole set of the injection hole 52 and the injection hole 53). C22 is defined as a circle that is formed by a line of intersection between: the specific imaginary plane SVp; and an imaginary conical surface that includes all of the secondary injection hole inner wall of the second injection hole set. Furthermore, d1 is defined as a distance between C11 and C12. Also, d2 is defined as a distance between: C11 or C12; and C21 or C22. Under the above setting, the first injection hole set and the second injection hole set are formed to satisfy a relationship of the following equation 4.

$$d1 < d2 \quad \text{Equation 4}$$

This is also true with respect to the relationship relative to the other injection hole set (the injection hole set of the injection hole 56 and the injection hole 55).

In the present embodiment, each injection hole 13 is formed such that the circle C, which is formed by the line of intersection between the specific imaginary plane SVp and the imaginary conical surface including all of the injection hole inner wall 133 of the injection hole 13, is placed on the piston 82 side of the imaginary plane Vp1.

In FIG. 6, each line of intersection (Cf1-Cf6) between the outline of the fuel mist injected from the corresponding injection hole 51-56 and the specific imaginary plane SVp is indicated by a dot-dot-dash line. In the present embodiment, the injection holes 51-56 satisfy the relationships of the equation 1 and the equation 2, and each injection hole set satisfies the relationships of the equation 3 and the equation 4. Therefore, the Coanda effect can be generated between the fuel mist, which is injected from the injection hole 51, and the fuel mist, which is injected from the injection hole 54. Also, the Coanda effect can be generated between the fuel mist, which is injected from the injection hole 52, and the fuel mist, which is injected from the injection hole 53.

Additionally, the Coanda effect can be generated between the fuel mist, which is injected from the injection hole 56, and the fuel mist, which is injected from the injection hole 55. In the present embodiment, a center of Cf1 is generally placed on C11, and a center of Cf4 is generally placed on C12. Also, a center of Cf2 is generally placed on C21, and a center of Cf3 is generally placed on C22.

Since FIGS. 3 to 6 are schematic diagrams, FIGS. 3 to 6 do not accurately indicate the taper angle, the injection-hole-to-injection-hole angle, the hole-set-to-hole-set angle and the distances for the respective injection holes. Furthermore, the primary central axis and the secondary central axis obliquely intersect with the specific imaginary plane SVp, so that the C11, C12, C21, C22, Cf1-Cf6 respectively look like in a form of an ellipse in reality in a view taken in the axial direction of the axis Ax1. However, for the sake of simplicity, C11, C12, C21, C22, Cf1-Cf6 are respectively shaped in a form of a circle in FIGS. 4 and 6.

Figure 7:
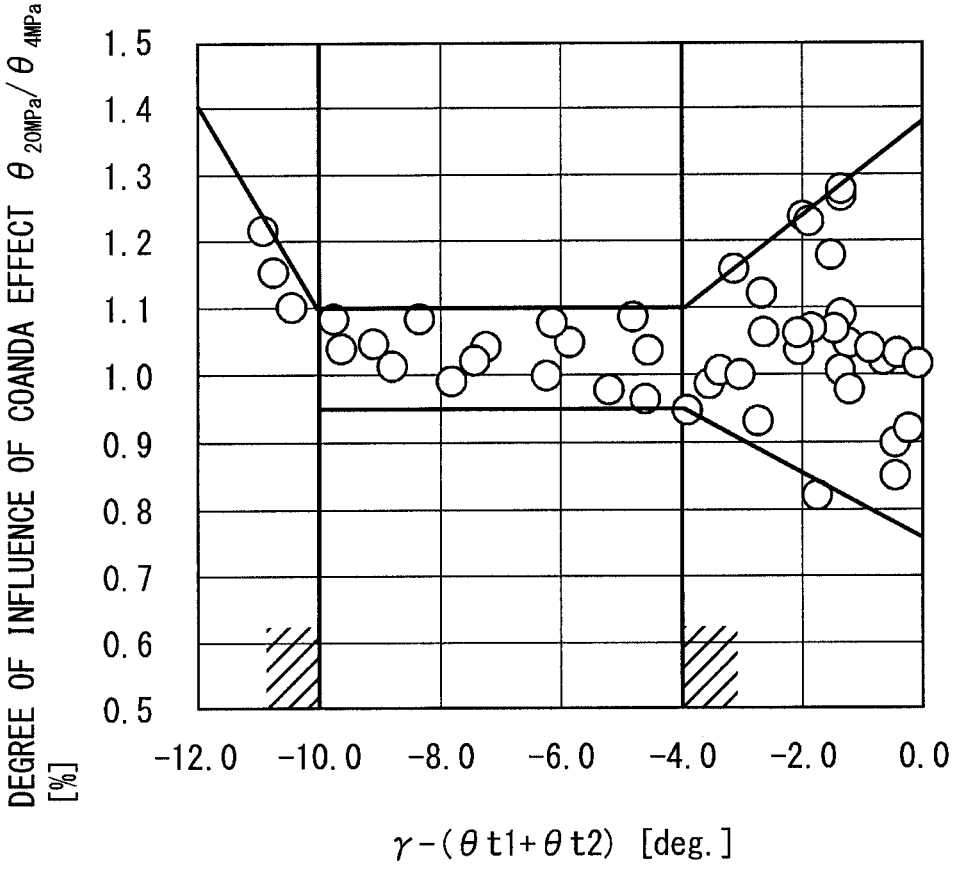
FIG. 7 is a diagram indicating a relationship between $\gamma-(\theta t1+\theta t2)$ and a degree of influence of the Coanda effect.

Next, FIG. 7 indicates a relationship between $\gamma-(\theta t1+\theta t2)$ and the degree of influence of the Coanda effect in the case where the pressure of the fuel in the fuel passage 100 is about 20 MPa that is assumed to be exerted in the fuel passage during the use of the fuel injection device 1 of the present embodiment. The result of the experiment, in which the fuel is injected from the fuel injection device 1, is indicated by plotting a plurality of circles in FIG. 7.

In general, when the pressure of the fuel to be injected (the pressure of the fuel in the fuel passage 100) is increased, the mist angle is increased, and thereby the degree of influence of the Coanda effect is increased. In a case where the pressure of the fuel in the fuel passage 100 is, for example, about 4 MPa, the influence of the Coanda effect can be substantially ignored. Therefore, the degree of influence of the Coanda effect (hereinafter, also referred to as "Coanda influence degree") is defined by a ratio between "an angle $\theta_{20\ MPa}$ of the fuel mist Fo, which is pulled in the case where P is 20", and "an angle $\theta_{4\ MPa}$ of the fuel mist Fo, which is pulled in the case where P is 4", and the degree of influence of the Coanda effect is indicated at an axis of ordinates in FIG. 7.

As shown in FIG. 7, in a case where $\gamma-(\theta t1+\theta t2)$ is −10.0 to −4.0, the Coanda influence degree is about 1.0 to 1.1. Therefore, in this range, the degree of influence of the Coanda effect can be stabilized, and thereby the Coanda effect can be stably generated between the fuel mist, which is injected from the primary injection hole, and the fuel mist, which is injected from the secondary injection hole.

In contrast, in the case where $\gamma-(\theta t1+\theta t2)$ is equal to or smaller than −10.0 or is equal to or larger than −4.0, the Coanda influence degree is about 0.8 to 1.4. Therefore, it is understood that the degree of influence of the Coanda effect becomes unstable in this range, and thereby it is difficult to stably generate the Coanda effect between the fuel mist, which is injected from the primary injection hole, and the fuel mist, which is injected from the secondary injection hole.

In the case where $\gamma-(\theta t1+\theta t2)$ is equal to or smaller than −10.0, the fuel mists may possibly collide with each other to cause an increase in a mist particle size of the fuel mists.

In the present embodiment, the injection holes 51-56 are formed to particularly satisfy the relationships of the equation 1 and the equation 2 described above. Therefore, the collision between the fuel mists can be limited while the Coanda effect is effectively generated between the fuel mists at the injection hole set.

As discussed above, (1) the fuel injection device 1 of the present embodiment includes the nozzle 10.

The nozzle 10 includes: the nozzle tubular portion 11 that forms the fuel passage 100 in the inside of the nozzle tubular portion 11; the nozzle bottom portion 12 that closes the one end of the nozzle tubular portion 11; and the plurality of injection holes 13 that connect between the surface 121 of the nozzle bottom portion 12, which is located on the side where the nozzle tubular portion 11 is placed, and the opposite surface 122 of the nozzle bottom portion 12, which is located on the opposite side that is opposite from the nozzle tubular portion 11, to inject the fuel of the fuel passage 100.

The injection holes 13 include at least one injection hole set (the set of the injection hole 51 and the injection hole 54, the set of the injection hole 52 and the injection hole 53, the set of the injection hole 56 and the injection hole 55) that includes the primary injection hole (the injection hole 51, the injection hole 52 or the injection hole 56) and the secondary injection hole (the injection hole 54, the injection hole 53 or the injection hole 55).

Each of the injection holes 51, 52, 56, which respectively serve as the primary injection hole, includes: the inlet opening (serving as the primary inlet opening) 131, which is formed at the nozzle tubular portion 11 side surface 121 of the nozzle bottom portion 12; the outlet opening (serving as the primary outlet opening) 132, which is formed at the opposite surface 122 of the nozzle bottom portion 12 located on the opposite side that is opposite from the nozzle tubular portion 11; and the injection hole inner wall (serving as the primary injection hole inner wall) 133, which connects between the inlet opening 131 and the outlet opening 132 and is tapered such that the injection hole inner wall 133 is progressively spaced away from the central axis (serving as the primary central axis) Ac1 from the inlet opening 131 side toward the outlet opening 132 side.

Each of the injection holes 54, 53, 55, which respectively serve as the secondary injection hole, includes: the inlet opening (serving as the secondary inlet opening) 131, which is formed at the surface 121 of the nozzle bottom portion 12 located on the side where the nozzle tubular portion 11 is placed; the outlet opening (serving as the secondary outlet opening) 132, which is formed at the opposite surface 122 of the nozzle bottom portion 12 located on the opposite side that is opposite from the nozzle tubular portion 11; and the injection hole inner wall (serving as the secondary injection hole inner wall) 133, which connects between the inlet opening 131 and the outlet opening 132 and is tapered such that the injection hole inner wall 133 is progressively spaced away from the central axis (serving as the secondary central axis) Ac1 from the inlet opening 131 side toward the outlet opening 132.

According to the present embodiment, with respect to one of the injection hole sets (the first injection hole set: the injection hole set of the injection hole 51 and the injection hole 54), $\gamma$ (deg) is defined as the injection-hole-to-injection-hole angle, which is the angle formed between the central axis (serving as the primary central axis) Ac11 of the injection hole 51 and the central axis (serving as the secondary central axis) Ac12 of the injection hole 54; $\theta t1$ (deg) is defined as the primary taper angle, which is the angle formed between the outlines of the injection hole inner wall (serving as the primary injection hole inner wall) 133 of the injection hole 51 in the cross section of the injection hole inner wall 133 taken along the imaginary plane that includes all of the primary central axis Ac11; $\theta t2$ (deg) is defined as the secondary taper angle, which is the angle formed between the outlines of the injection hole inner wall (serving as the secondary injection hole inner wall) 133 of the injection hole 54 in the cross section of the injection hole inner wall 133 taken along the imaginary plane that includes all of the secondary central axis Ac12; and P (MPa) is defined as the average pressure of the fuel in the fuel passage 100 at the time of injecting the fuel from the plurality of injection holes 13. Under the above setting, the injection hole (serving as the primary injection hole) 51 and the injection hole (serving as the secondary injection hole) 54 are formed to satisfy the relationship of the following equation 1.

$$\gamma \leq \theta t1 + \theta t2 - 0.87 \times P^{0.52} \quad \text{Equation 1}$$

In the present embodiment, the primary injection hole and the secondary injection hole are formed to satisfy the equation 1, so that the Coanda effect can be effectively generated between the fuel mist, which is injected from the primary injection hole, and the fuel mist, which is injected from the secondary injection hole.

Furthermore, according to the present embodiment, the primary injection hole inner wall and the secondary injection hole inner wall are tapered, so that the primary injection hole or the secondary injection hole discharges the fuel to spread the fuel. Therefore, it is possible to reduce a difference between: the mist angle of the fuel mist, which is injected from each injection hole 13 in the state where the fuel pressure in the fuel passage 100 is high; and the mist angle of the fuel mist, which is injected from each injection hole 13 in the state where the fuel pressure in the fuel passage 100 is low. Therefore, even when the fuel pressure in the fuel passage 100 changes, it is possible to limit a change in the mist angle of the fuel mist, which is injected from the primary injection hole or the secondary injection hole. Thereby, regardless of the change in the fuel pressure, the Coanda effect can be stably generated between the fuel mist, which is injected from the primary injection hole, and the fuel mist, which is injected from the secondary injection hole. Thus, regardless of the change in the fuel pressure, a rich mixture gas, which is atomized at the area between the fuel mists, can be stably generated.

Furthermore, (2) according to the present embodiment, the primary injection hole and the secondary injection hole are formed to satisfy the relationship of the following equation 2.

$$\theta t1 + \theta t2 - 10 \leq \gamma \quad \text{Equation 2}$$

Therefore, it is possible to limit occurrence of collision between the fuel mists that would cause interference against the atomization of the fuel mist at the center side between the fuel mists.

Furthermore, (3), according to the present embodiment, the injection holes 13 include the three injection hole sets.

Here, α (deg) is defined as the hole-set-to-hole-set angle that is the angle formed between: the primary central axis or the secondary central axis of the first injection hole set, which is the one injection hole set selected from the three injection hole sets; and the primary central axis or the secondary central axis of the second injection hole set, which is the different injection hole set that is different from the first injection hole set among the three injection hole sets. Under the above setting, the first injection hole set and the second injection hole set are formed to satisfy the relationship of the following equation 3.

$$\gamma < \alpha \quad \text{Equation 3}$$

Therefore, the Coanda effect may be effectively generated between the fuel mists that are injected from the one injection hole set while generation of the Coanda effect may be minimized between: any one of the fuel mists that are injected from the one injection hole set; and any one of the fuel mists that are injected from the other injection hole set. Therefore, in the structure that includes the plurality of injection hole sets, regardless of the change in the fuel pressure, the rich mixture gas, which is atomized at the center side between the fuel mists, can be more stably generated.

Furthermore, (4) according to the present embodiment, C11 is defined as the circle that is formed by the line of intersection between: the specific imaginary plane SVp; and the imaginary conical surface that includes all of the primary injection hole inner wall of the first injection hole set. The specific imaginary plane SVp is the imaginary plane spaced from the nozzle bottom portion 12 by the predetermined distance Dt on the opposite side, which is opposite from the nozzle tubular portion 11, while the imaginary plane is perpendicular to the axis Ax1 of the nozzle tubular portion 11. C12 is defined as the circle that is formed by the line of intersection between: the specific imaginary plane SVp; and the imaginary conical surface that includes all of the secondary injection hole inner wall of the first injection hole set. C21 is defined as the circle that is formed by the line of intersection between: the specific imaginary plane SVp; and the imaginary conical surface that includes all of the primary injection hole inner wall of the second injection hole set. C22 is defined as the circle that is formed by the line of intersection between: the specific imaginary plane SVp; and the imaginary conical surface that includes all of the secondary injection hole inner wall of the second injection hole set. Furthermore, d1 is defined as the distance between C11 and C12. Also, d2 is defined as the distance between: C11 or C12; and C21 or C22. Under the above setting, the first injection hole set and the second injection hole set are formed to satisfy a relationship of the following equation 4.

$$d1 < d2 \quad \text{Equation 4}$$

Therefore, the Coanda effect may be effectively generated between the fuel mists that are injected from the one injection hole set while generation of the Coanda effect may be minimized between: any one of the fuel mists that are injected from the one injection hole set; and any one of the fuel mists that are injected from the other injection hole set. Thereby, in the structure that includes the plurality of injection hole sets, regardless of the change in the fuel pressure, the rich mixture gas, which is atomized at the center side between the fuel mists, can be further stably generated.

Furthermore, (5) according to the present embodiment, the nozzle 10 includes the valve seat 14 that is formed at the inner wall of the nozzle 10. The fuel injection device 1 of the present embodiment further includes the housing 20, the needle 30, the movable core 40, the stationary core 41, the coil 44 and the spring 43.

The housing 20 is shaped into the tubular form and is connected to the opposite side of the nozzle tubular portion 11, which is opposite from the nozzle bottom portion 12.

The needle 30 is placed in the inside of the housing 20 such that the needle 30 has the one end, which is contactable with the valve seat 14, and the needle 30 is operable to reciprocate in the axial direction. When the one end of the needle 30 is lifted from the valve seat 14 or contacts the valve seat 14, the needle 30 opens or closes the injection holes 13.

The movable core 40 is placed such that the movable core 40 is operable to reciprocate in the inside of the housing 20 together with the needle 30.

The stationary core 41 is placed on the opposite side of the movable core 40, which is opposite from the valve seat 14, in the inside of the housing 20.

The coil 44 is operable to attract the movable core 40 toward the stationary core 41 to move the needle 30 toward the opposite side that is opposite from the valve seat 14 at the time of energizing the coil 44.

The spring 43 is operable to urge the needle 30 and the movable core 40 toward the valve seat 14.

As discussed above, the fuel injection device 1 of the present embodiment is a fuel injection device of an electromagnetic drive type.

Second Embodiment

Figure 8:
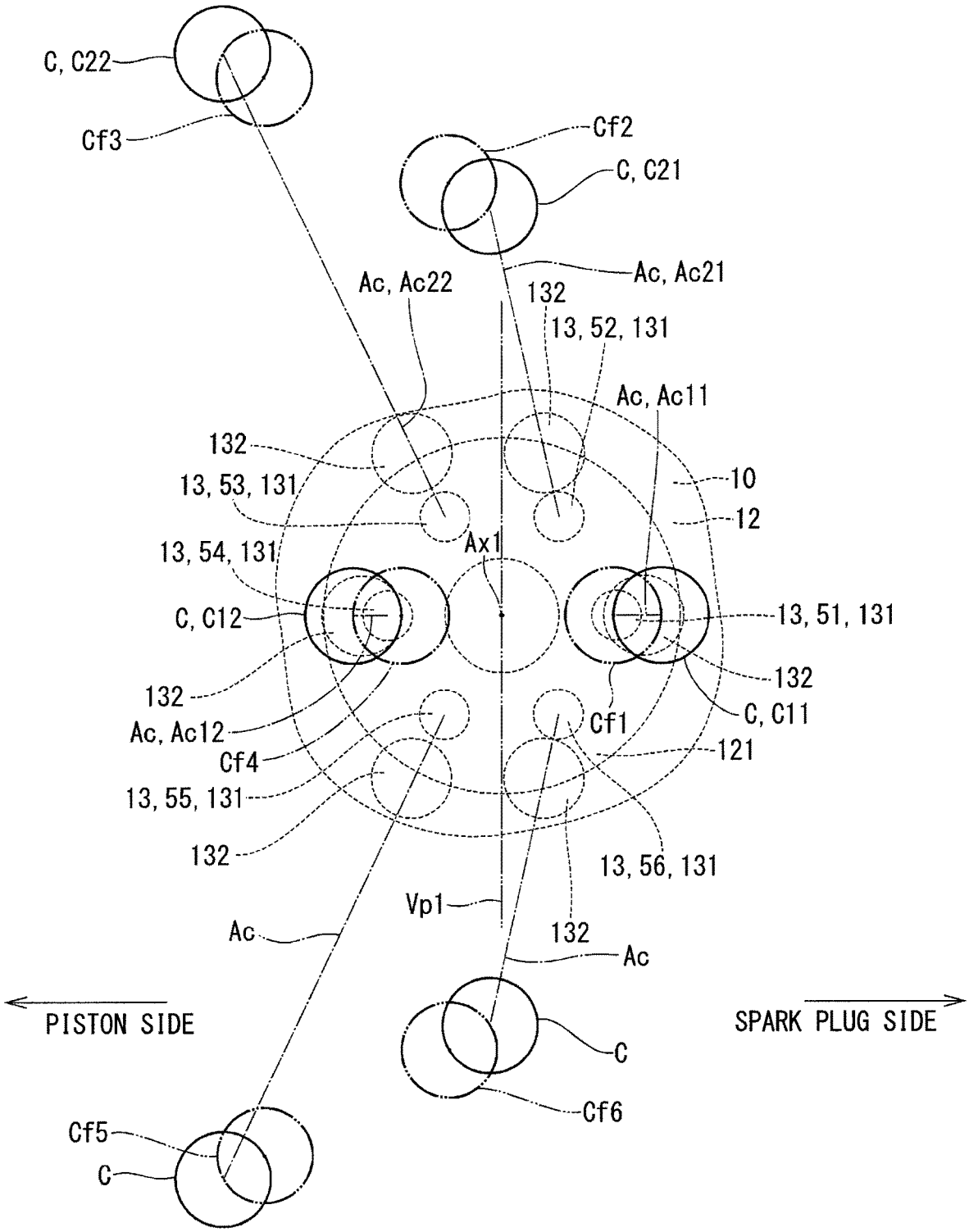
FIG. 8 is a schematic diagram showing a positional relationship among fuel mists injected from a fuel injection device according to a second embodiment of the present disclosure.

FIG. 8 indicates a portion of a fuel injection device according to a second embodiment of the present disclosure.

In the second embodiment, the injection hole 51 is formed such that the circle C, which is formed by the line of intersection between: the specific imaginary plane SVp; and the imaginary conical surface that includes all of the injection hole inner wall 133 of the injection hole 51, is located on the spark plug 97 side of the imaginary plane Vp1.

Each of the injection holes 53, 54, 55 is formed such that the circle C, which is formed by the line of intersection between: the specific imaginary plane SVp; and the imaginary conical surface that includes all of the injection hole inner wall 133 of the injection hole 53, 54, 55, is located on the piston 82 side of the imaginary plane Vp1.

The rest of the structure of the second embodiment, which is other than the above-described points, is the same as that of the first embodiment.

Even in the second embodiment, advantages, which are similar to those of the first embodiment, can be achieved.

Third Embodiment

Figure 9:
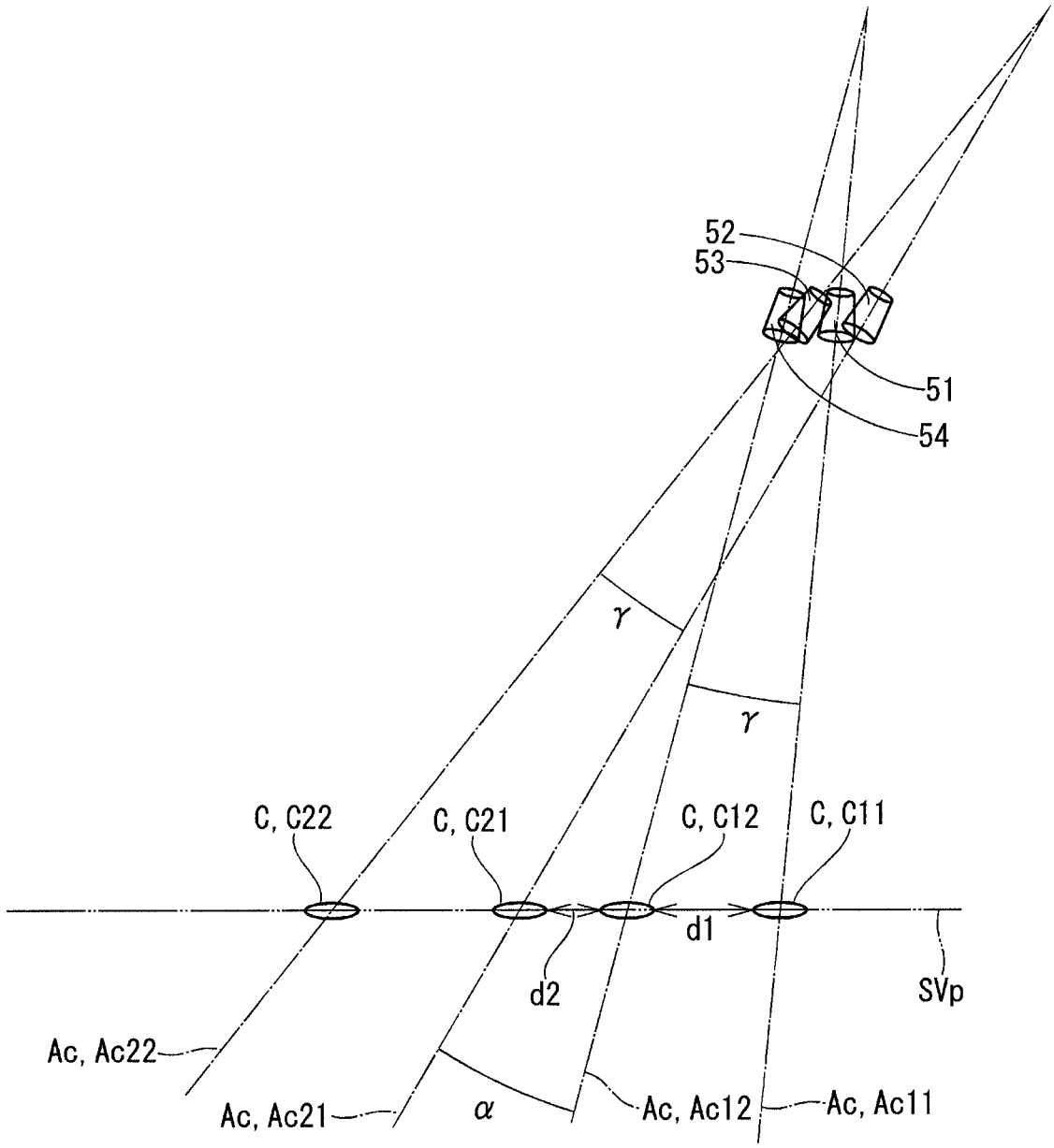
FIG. 9 is a schematic diagram showing a relationship among injection holes of a fuel injection device according to a third embodiment of the present disclosure.

FIG. 9 indicates a portion of a fuel injection device according to a third embodiment of the present disclosure.

In the third embodiment, $\alpha$ (deg) is defined as a hole-set-to-hole-set angle that is an angle formed between: the primary central axis Ac11 or the secondary central axis Ac12 of the first injection hole set (e.g., the injection hole set of the injection hole 51 and the injection hole 54), which is the one injection hole set selected from the three injection hole sets; and the primary central axis Ac21 or the secondary central axis Ac22 of the second injection hole set (e.g., the injection hole set of the injection hole 52 and the injection hole 53), which is the different injection hole set that is different from the first injection hole set among the three injection hole sets. Under the above setting, the first injection hole set and the second injection hole set are formed to satisfy the relationship of the following equation 3.

$$\gamma<\alpha \qquad \text{Equation 3}$$

However, in the present embodiment, C11 is defined as the circle that is formed by the line of intersection between: the specific imaginary plane SVp; and the imaginary conical surface that includes all of the primary injection hole inner wall of the first injection hole set (e.g., the injection hole set of the injection hole 51 and the injection hole 54). C12 is defined as the circle that is formed by the line of intersection between: the specific imaginary plane SVp; and the imaginary conical surface that includes all of the secondary injection hole inner wall of the first injection hole set. C21 is defined as the circle that is formed by the line of intersection between: the specific imaginary plane; and the imaginary conical surface that includes all of the primary injection hole inner wall of the second injection hole set (e.g., the injection hole set of the injection hole 52 and the injection hole 53). C22 is defined as the circle that is formed by the line of intersection between: the specific imaginary plane SVp; and the imaginary conical surface that includes all of the secondary injection hole inner wall of the second injection hole set. Furthermore, d1 is defined as the distance between C11 and C12. Also, d2 is defined as the distance between: C11 or C12; and C21 or C22. Under the above setting, the first injection hole set and the second injection hole set are formed to satisfy a relationship of the following equation 5.

$$d1>d2 \qquad \text{Equation 5}$$

This is also true with respect to the relationship relative to the other injection hole set (the injection hole set of the injection hole 56 and the injection hole 55).

As described above, according to the present embodiment, unlike the first embodiment, the first injection hole set and the second injection hole set are formed to satisfy the above equation 5 rather than the above equation 4. However, in the present embodiment, similar to the first embodiment, the first injection hole set and the second injection hole set are formed to satisfy the above equation 3. Therefore, even in the third embodiment, advantages, which are similar to those of the first embodiment, can be achieved.

Fourth Embodiment

Figure 10:
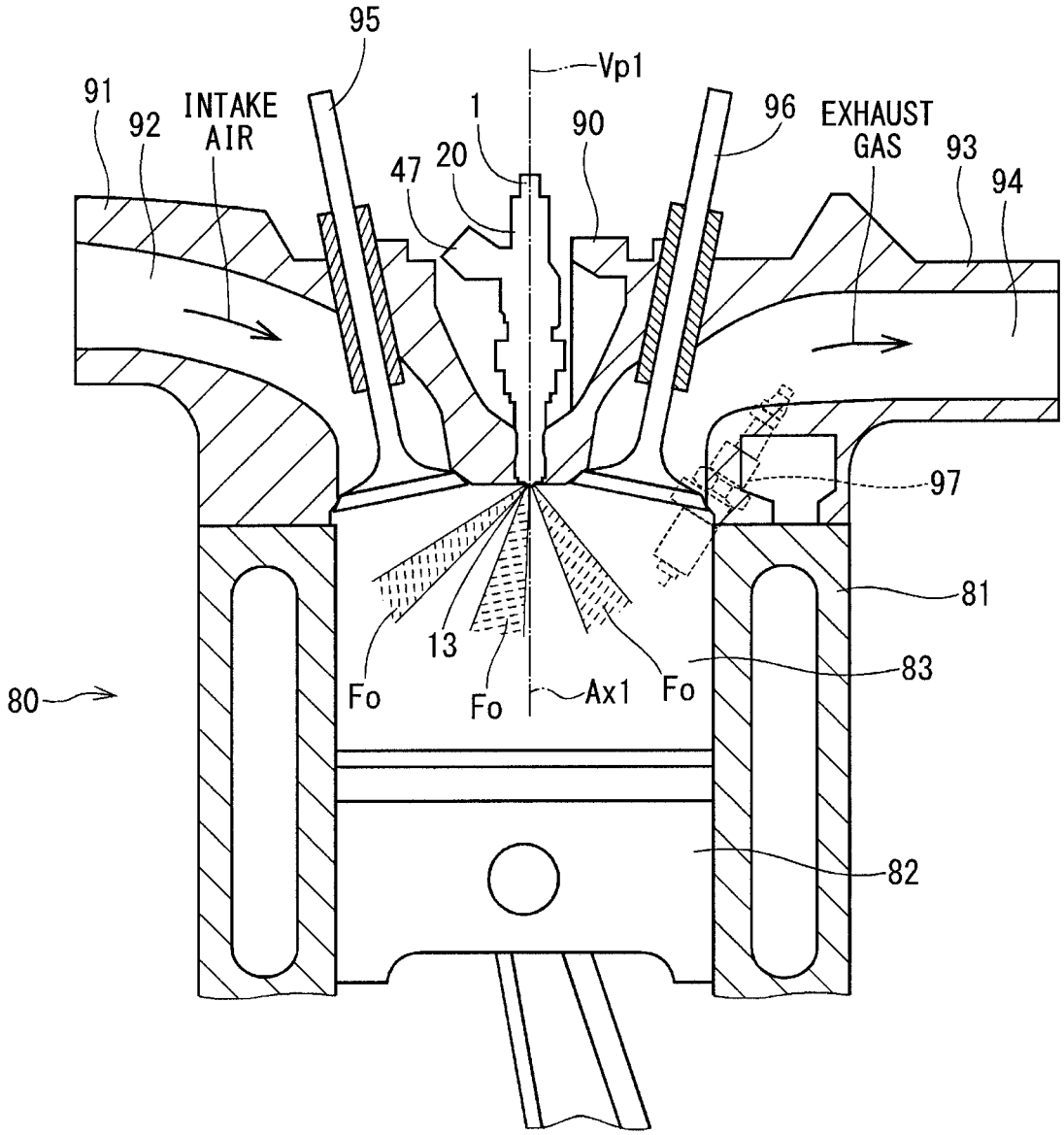
FIG. 10 is a diagram showing a state where a fuel injection device according to a fourth embodiment of the present disclosure is applied to the internal combustion engine.
Figure 11:
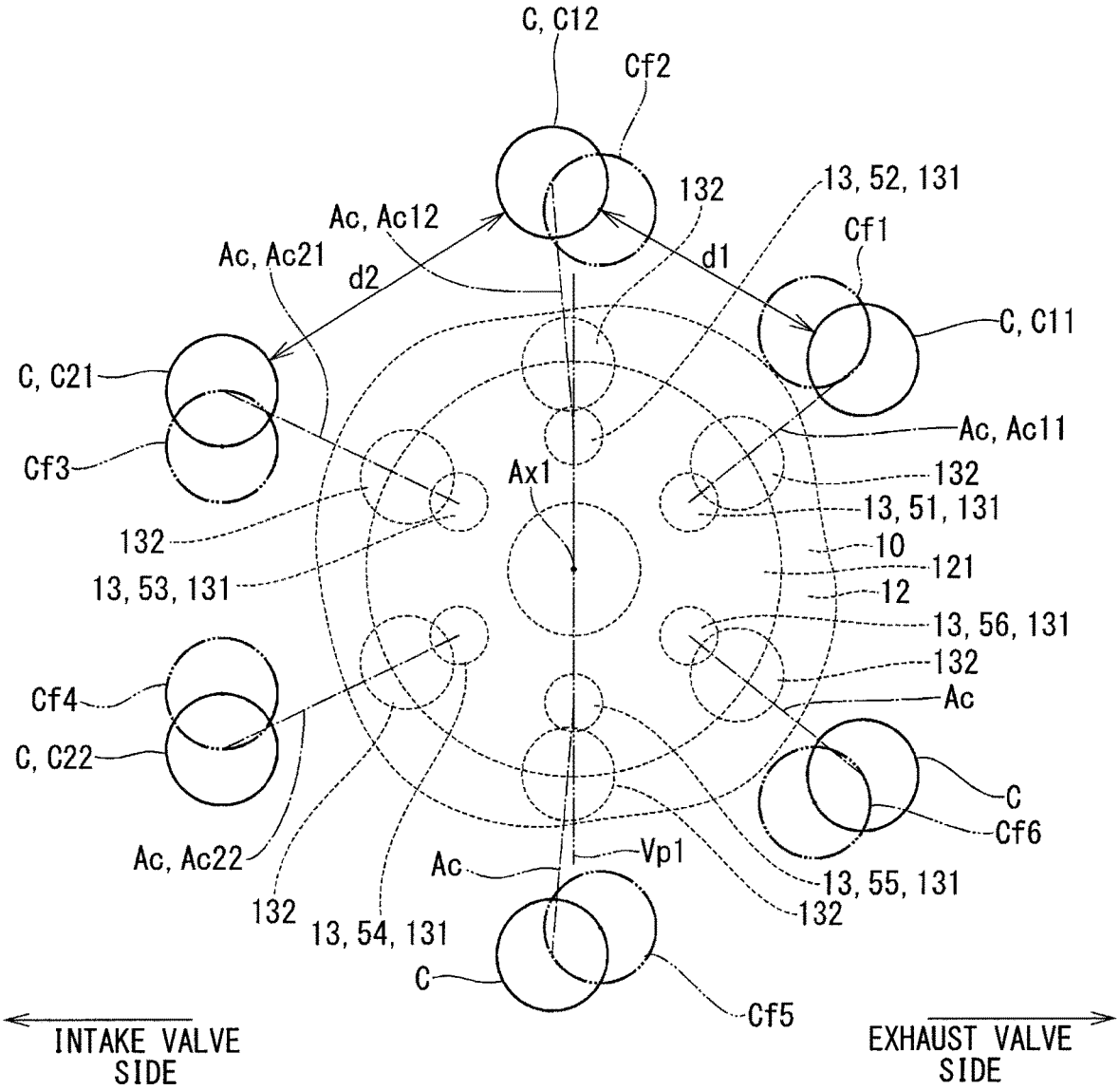
FIG. 11 is a schematic diagram showing a positional relationship among fuel mists injected from the fuel injection device according to the fourth embodiment of the present disclosure.

FIGS. 10 and 11 show a fuel injection device according to a fourth embodiment of the present disclosure. The fourth embodiment differs from the first embodiment with respect to an installation location of the fuel injection device 1 and the like at the engine 80.

As shown in FIG. 10, in the present embodiment, the fuel injection device 1 is placed at a corresponding location of the cylinder head 90, which is between the intake valve 95 and the exhaust valve 96, i.e., a corresponding location of the cylinder head 90 that corresponds to a center of the combustion chamber 83. The fuel injection device 1 is placed such that an axis of the fuel injection device 1 is generally parallel to the axis of the combustion chamber 83 or substantially coincides with the axis of the combustion chamber 83. In the present embodiment, the fuel injection device 1 is placed in the center at the upper side of the engine 80 in the vertical direction. That is, the fuel injection device 1 is mounted to the center of the engine 80.

Furthermore, at the cylinder block 81 side of the exhaust manifold 93, the spark plug 97 is placed at the location where the fuel injected from the fuel injection device 1 does not directly adhere to the spark plug 97, and the spark plug 97 can ignite the mixture gas (combustible air), which is the mixture of the fuel and the intake air.

The fuel injection device 1 is installed to the engine 80 such that the intake valve 95 is placed on one side of the imaginary plane Vp1, and the exhaust valve 96 and the spark plug 97 are placed on the other side of the imaginary plane Vp1.

The fuel injection device 1 is placed such that the injection holes 13 are exposed to an opposite side of the combustion chamber 83 that is opposite from the piston 82 in the axial direction. The conical fuel mist Fo is injected from the respective injection holes 13 of the fuel injection device 1 into the combustion chamber 83.

As shown in FIG. 11, in the fourth embodiment, the fuel injection device 1 is installed to the engine 80 such that the injection holes 51, 56 are placed on the exhaust valve 96 side of the imaginary plane Vp1, and the injection holes 52, 55 are slightly deviated relative to the imaginary plane Vp1 toward the intake valve 95 side, and the injection holes 53, 54 are placed on the intake valve 95 side of the imaginary plane Vp1.

In the fourth embodiment, the injection holes 13 include three injection hole sets (an injection hole set of the injection hole 51 and the injection hole 52, an injection hole set of the injection hole 53 and the injection hole 54, and an injection hole set of the injection hole 55 and the injection hole 56).

According to the present embodiment, with respect to one of the injection hole sets (e.g., the first injection hole set: the injection hole set of the injection hole 51 and the injection hole 52), γ (deg) is defined as the injection-hole-to-injection-hole angle, which is the angle formed between the central axis (serving as the primary central axis) Ac11 of the injection hole 51 and the central axis (serving as the secondary central axis) Ac12 of the injection hole 52; θt1 (deg) is defined as the primary taper angle, which is the angle formed between the outlines of the injection hole inner wall (serving as the as the primary injection hole inner wall) 133 of the injection hole 51 in the cross section of the injection hole inner wall 133 taken along the imaginary plane that includes all of the primary central axis Ac11; θt2 (deg) is defined as the secondary taper angle, which is the angle formed between the outlines of the injection hole inner wall (serving as the secondary injection hole inner wall) 133 of the injection hole 52 in the cross section of the injection hole inner wall 133 taken along the imaginary plane that includes all of the secondary central axis Ac12; and P (MPa) is defined as the average pressure of the fuel in the fuel passage 100 at the time of injecting the fuel from the plurality of injection holes 13. Under the above setting, the injection hole (serving as the primary injection hole) 51 and the injection hole (serving as the secondary injection hole) 52 are formed to satisfy the relationship of the following equation 1.

$$\gamma \leq \theta t1 + \theta t2 - 0.87 \times P \hat{}\, 0.52 \qquad \text{Equation 1}$$

Furthermore, according to the present embodiment, the primary injection hole and the secondary injection hole are formed to satisfy the relationship of the following equation 2

$$\theta t1 + \theta t2 - 10 \leq \gamma \qquad \text{Equation 2}$$

Similarly, the primary injection hole and the secondary injection hole of the other injection hole sets (the injection hole set of the injection hole 53 and the injection hole 54, and the injection hole set of the injection hole 55 and the injection hole 56) are also formed to satisfy the relationships of the equation 1 and the equation 2.

Furthermore, α (deg) is defined as the hole-set-to-hole-set angle that is the angle formed between: the primary central axis Ac11 or the secondary central axis Ac12 of the first injection hole set (e.g., the injection hole set of the injection hole 51 and the injection hole 52), which is the one injection hole set selected from the three injection hole sets; and the primary central axis Ac21 or the secondary central axis Ac22 of the second injection hole set (e.g., the injection hole set of the injection hole 53 and the injection hole 54), which is the different injection hole set that is different from the first injection hole set among the three injection hole sets. Under the above setting, the first injection hole set and the second injection hole set are formed to satisfy the relationship of the following equation 3.

$$\gamma < \alpha \qquad \text{Equation 3}$$

Furthermore, in the present embodiment, C11 is defined as the circle that is formed by the line of intersection between: the specific imaginary plane SVp; and the imaginary conical surface that includes all of the primary injection hole inner wall of the first injection hole set (e.g., the injection hole set of the injection hole 51 and the injection hole 52). C12 is defined as the circle that is formed by the line of intersection between: the specific imaginary plane SVp; and the imaginary conical surface that includes all of the secondary injection hole inner wall of the first injection hole set. C21 is defined as the circle that is formed by the line of intersection between: the specific imaginary plane; and the imaginary conical surface that includes all of the primary injection hole inner wall of the second injection hole set (e.g., the injection hole set of the injection hole 53 and the injection hole 54). C22 is defined as the circle that is formed by the line of intersection between: the specific imaginary plane SVp; and the imaginary conical surface that includes all of the secondary injection hole inner wall of the second injection hole set. Furthermore, d1 is defined as the distance between C11 and C12. Also, d2 is defined as the distance between: C11 or C12; and C21 or C22. Under the above setting, the first injection hole set and the second injection hole set are formed to satisfy the relationship of the following equation 5.

$$d1 > d2 \qquad \text{Equation 5}$$

This is also true with respect to the relationship relative to the other injection hole set (the injection hole set of the injection hole 55 and the injection hole 56).

Even in the fourth embodiment, advantages, which are similar to those of the first embodiment, can be achieved.

Fifth Embodiment

Figure 12:
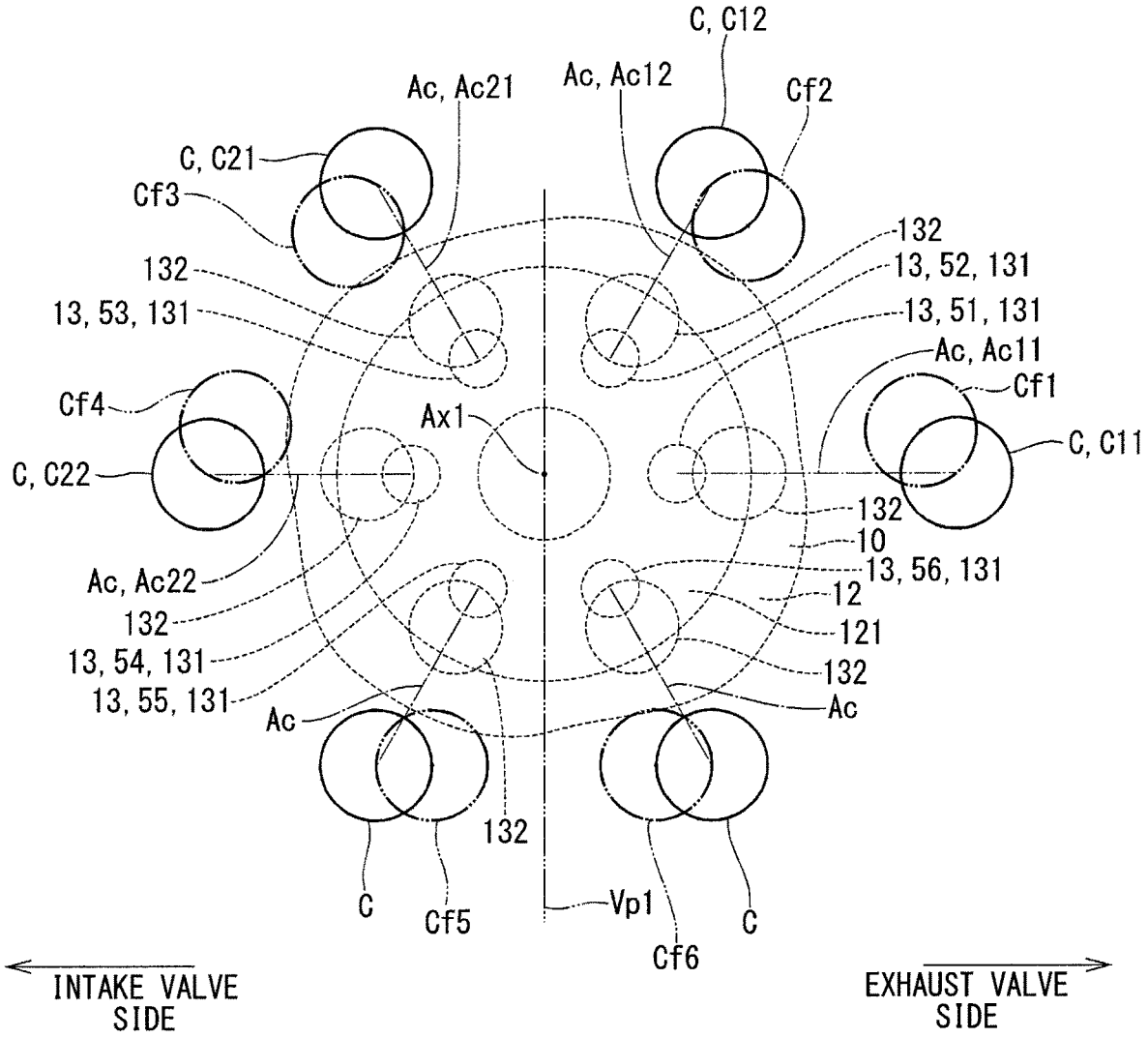
FIG. 12 is a schematic diagram showing a positional relationship among fuel mists injected from a fuel injection device according to a fifth embodiment of the present disclosure.

FIG. 12 indicates a portion of a fuel injection device according to a fifth embodiment of the present disclosure. The fifth embodiment differs from the fourth embodiment with respect to a way of installing the fuel injection device 1 at the engine 80.

In the fifth embodiment, the fuel injection device 1 is installed to the engine 80 such that the injection holes 51, 52, 56 are placed on the exhaust valve 96 side of the imaginary plane Vp1, and the injection holes 53, 54, 55 are placed on the intake valve 95 side of the imaginary plane Vp1.

In the fifth embodiment, the injection holes 13 include the three injection hole sets (the injection hole set of the injection hole 51 and the injection hole 52, the injection hole set of the injection hole 53 and the injection hole 54, and the injection hole set of the injection hole 55 and the injection hole 56).

In the present embodiment, similar to the fourth embodiment, the injection holes 51-56 are formed to satisfy the equation 1 and the equation 2 described above. Furthermore, the three injection hole sets are formed to satisfy the relationship of the above equation 3.

In the present embodiment, the distance between the outlet opening 132 of the injection hole 51 and the axis Ax1 is set to be larger than the distance between the outlet opening 132 of each of the injection holes 52-56 and the axis Ax1.

Even in the fifth embodiment, advantages, which are similar to those of the fourth embodiment, can be achieved.

Sixth Embodiment

Figure 13:
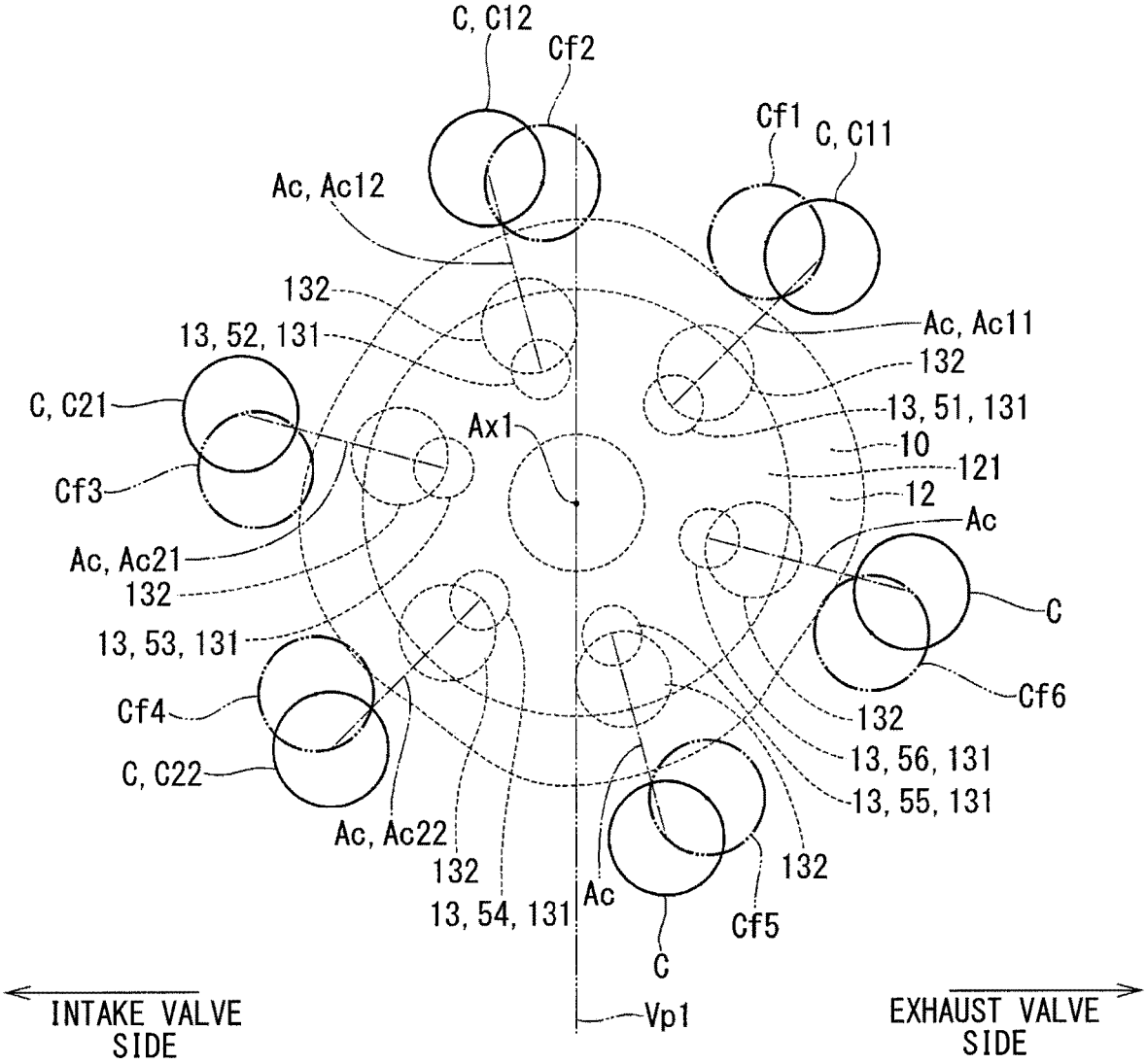
FIG. 13 is a schematic diagram showing a positional relationship among fuel mists injected from a fuel injection device according to a sixth embodiment of the present disclosure.

FIG. 13 indicates a portion of a fuel injection device according to a sixth embodiment of the present disclosure.

The sixth embodiment differs from the fifth embodiment with respect to a way of installing the fuel injection device 1 at the engine 80. In the sixth embodiment, the fuel injection device 1 is installed to the engine 80 such that the injection holes 51, 55, 56 are placed on the exhaust valve 96 side of the imaginary plane Vp1, and the injection holes 52, 53, 54 are placed on the intake valve 95 side of the imaginary plane Vp1.

In the sixth embodiment, the injection holes 13 include the three injection hole sets (the injection hole set of the injection hole 51 and the injection hole 52, the injection hole set of the injection hole 53 and the injection hole 54, and the injection hole set of the injection hole 55 and the injection hole 56).

In the present embodiment, similar to the fifth embodiment, the injection holes 51-56 are formed to satisfy the equation 1 and the equation 2 described above. Furthermore, the three injection hole sets are formed to satisfy the relationship of the above equation 3.

In the present embodiment, the distance between the outlet opening 132 of each of the injection holes 51-56 and the axis Ax1 is set to be identical.

Even in the sixth embodiment, advantages, which are similar to those of the fifth embodiment, can be achieved.

Other Embodiments

In another embodiment of the present disclosure, the primary injection hole and the secondary injection hole may be formed to satisfy only the above equation 1. That is, it is not required to form the primary injection hole and the secondary injection hole to satisfy the above equation 2. Furthermore, it is not required to form the first injection hole set and the second injection hole set to satisfy the equation 3 and the equation 4 described above. In the case where the primary injection hole and the secondary injection hole are formed to satisfy the equation 1 and the equation 2, and the first injection hole set and the second injection hole set are formed to satisfy the equation 3 and the equation 4 like in the first embodiment, the various advantages discussed in the first embodiment can be achieved.

In the above embodiments, there are described the exemplary cases where the injection holes 13 include the three injection hole sets. Alternatively, in another embodiment of the present disclosure, the injection holes 13 may include one injection hole set, two injection hole sets, four injection hole sets or more.

In the above embodiments, the taper angle ($\theta t1$, $\theta t2$) of each of the injection holes 51-56 is set to, for example, about 18 (deg). Alternatively, in another embodiment of the present disclosure, the taper angle $\theta t1$, $\theta t2$ may be set to any value as long as the taper angle $\theta t1$, $\theta t2$ is larger than 0 degrees and is smaller than 90 degrees.

In the above embodiments, there are described the exemplary cases where the movable core 40 is formed integrally with the needle 30. In contrast, according to another embodiment of the present disclosure, the movable core 40 may be formed to be movable relative to the needle 30, and the needle 30 may have a surface that is contactable with the movable core 40 and is placed on the valve seat 14 side. In this case, it is desirable to have a stationary core side urging member that urges the movable core 40 toward the stationary core 41 side.

Furthermore, in another embodiment of the present disclosure, the nozzle tubular portion 11 of the nozzle 10 and the first tubular member 21 of the housing 20 may be integrally formed in one piece. Furthermore, the nozzle tubular portion 11 and the nozzle bottom portion 12 may be separately formed.

In another embodiment of the present disclosure, the fuel injection device may not have the valve seat 14, the housing 20, the needle 30, the movable core 40, the stationary core 41, the coil 44 and the spring 43 and may only include the nozzle 10. In such a case, the fuel injection device may be installed to a fuel supply portion, to which the fuel is intermittently or continuously supplied, so that the fuel injection device injects the fuel from the injection holes 13.

In another embodiment of the present disclosure, the average pressure P of the fuel passage 100 at the time of injecting the fuel from the injection holes 13 is not necessary limited to 20 MPa and may be in a range of about 20 to 100 MPa.

Furthermore, in the above embodiments, there are described the exemplary cases where the fuel injection device is installed to the direct injection gasoline engine. Alternatively, in another embodiment of the present disclosure, the fuel injection device may be applied to a diesel engine or a port injection gasoline engine.

As described above, the present disclosure should not be limited to the above embodiments and may be implemented in various other forms without departing from the scope of the present disclosure.

The invention claimed is:

1. A fuel injection device comprising a nozzle that includes:

a nozzle tubular portion that forms a fuel passage in an inside of the nozzle tubular portion;

a nozzle bottom portion that closes one end of the nozzle tubular portion; and a plurality of injection holes that connect between one surface of the nozzle bottom portion, which is located on a side where the nozzle tubular portion is placed, and an opposite surface of the nozzle bottom portion, which is located on an opposite side that is opposite from the nozzle tubular portion, to inject fuel of the fuel passage, wherein:

the plurality of fuel injection holes includes at least one injection hole set that includes:

a primary injection hole that has:

a primary inlet opening, which is formed at the one surface of the nozzle bottom portion located on the side where the nozzle tubular portion is placed;

a primary outlet opening, which is formed at the opposite surface of the nozzle bottom portion located on the opposite side that is opposite from the nozzle tubular portion; and a primary injection hole inner wall, which is tapered such that the primary injection hole inner wall is progressively spaced away from a primary central axis, which is a central axis of the primary injection hole, from the primary inlet opening side toward the primary outlet opening side; and a secondary injection hole that has:

a secondary inlet opening, which is formed at the one surface of the nozzle bottom portion located on the side where the nozzle tubular portion is placed;

a secondary outlet opening, which is formed at the opposite surface of the nozzle bottom portion located on the opposite side that is opposite from the nozzle tubular portion; and a secondary injection hole inner wall, which is tapered such that the secondary injection hole inner wall is progressively spaced away from a secondary central axis, which is a central axis of the secondary injection hole, from the secondary inlet opening side toward the secondary outlet opening side;

with respect to the injection hole set, γ (deg) is defined as an injection-hole-to-injection-hole angle, which is an angle formed between the primary central axis and a straight line while the straight line extends from a point along the primary central axis in parallel with the secondary central axis; θt1 (deg) is defined as a primary taper angle, which is an angle formed between outlines of the primary injection hole inner wall in a cross section of the primary injection hole inner wall taken along an imaginary plane that includes all of the primary central axis; θt2 (deg) is defined as a secondary taper angle, which is an angle formed between outlines of the secondary injection hole inner wall in a cross section of the secondary injection hole inner wall taken along an imaginary plane that includes all of the secondary central axis; and P (MPa) is defined as an average pressure of the fuel in the fuel passage at a time of injecting the fuel from the plurality of injection holes; and the primary injection hole and the secondary injection hole are formed to satisfy a relationship of the following equation 1:

$$0<\gamma\leq\theta t1+\theta t2-0.87\times P\hat{}0.52 \quad \text{Equation 1}$$

where ^ of the equation 1 denotes "to a power of."

2. The fuel injection device according to claim 1, wherein the primary injection hole and the secondary injection hole are adjacent to each other in a circumferential direction of the nozzle bottom portion.

3. The fuel injection device according to claim 1, wherein the primary injection hole and the secondary injection hole are formed to satisfy a relationship of the following equation 2:

$$\theta t1+\theta t2-10\leq\gamma \quad \text{Equation 2.}$$

4. The fuel injection device according to claim 1, wherein:

the at least one injection hole set of the plurality of injection holes includes a plurality of injection hole sets;

α (deg) is defined as a hole-set-to-hole-set angle that is an angle formed between:

the primary central axis or the secondary central axis of a first injection hole set, which is a selected one that is selected from the plurality of injection hole sets; and the primary central axis or the secondary central axis of a second injection hole set, which is a different injection hole set that is different from the first injection hole set among the plurality of injection hole sets; and the first injection hole set and the second injection hole set are formed to satisfy a relationship of the following equation 3:

$$\gamma<\alpha \quad \text{Equation 3.}$$

5. The fuel injection device according to claim 4, wherein:

C11 is defined as a circle that is formed by a line of intersection between:

a specific imaginary plane that is an imaginary plane spaced from the nozzle bottom portion by a predetermined distance on the opposite side, which is opposite from the nozzle tubular portion, while the imaginary plane is perpendicular to an axis of the nozzle tubular portion; and an imaginary conical surface that includes all of the primary injection hole inner wall of the first injection hole set;

C12 is defined as a circle that is formed by a line of intersection between:

the specific imaginary plane; and an imaginary conical surface that includes all of the secondary injection hole inner wall of the first injection hole set;

C21 is defined as a circle that is formed by a line of intersection between:

the specific imaginary plane; and an imaginary conical surface that includes all of the primary injection hole inner wall of the second injection hole set;

C22 is defined as a circle that is formed by a line of intersection between:

the specific imaginary plane; and an imaginary conical surface that includes all of the secondary injection hole inner wall of the second injection hole set;

d1 is defined as a distance between C11 and C12;

d2 is defined as a distance between: C11 or C12; and C21 or C22; and the first injection hole set and the second injection hole set are formed to satisfy a relationship of the following equation 4:

$$d1<d2 \quad \text{Equation 4.}$$

6. The fuel injection device according to claim 1, wherein:

the nozzle includes a valve seat that is formed at an inner wall of the nozzle; and the fuel injection device further comprising:

a housing that is shaped into a tubular form and is connected to an opposite side of the nozzle tubular portion, which is opposite from the nozzle bottom portion;

a needle that is placed in an inside of the housing such that the needle has one end, which is contactable with the valve seat, and the needle is operable to reciprocate in an axial direction, wherein when the one end of the needle is lifted from the valve seat or contacts the valve seat, the needle opens or closes the plurality of injection holes;

a movable core that is placed such that the movable core is operable to reciprocate in an inside of the housing together with the needle;

a stationary core that is placed on an opposite side of the movable core, which is opposite from the valve seat, in the inside of the housing;

a coil that is operable to attract the movable core toward the stationary core to move the needle toward an opposite side that is opposite from the valve seat at a time of energizing the coil; and a valve seat side urging member that is operable to urge the needle and the movable core toward the valve seat.

* * * * *